US008726684B2

(12) United States Patent
Maire

(10) Patent No.: US 8,726,684 B2
(45) Date of Patent: May 20, 2014

(54) REVERSIBLE SYSTEM FOR RECOVERING OF HEAT ENERGY BY SAMPLING AND TRANSFER OF CALORIES FROM ONE OR MORE MEDIA INTO ONE OR MORE OTHER SUCH MEDIA

(76) Inventor: Jean-Luc Maire, Le Plessis-Robinson (FR)

( * ) Notice: Subject to any disclaimer, the term of this patent is extended or adjusted under 35 U.S.C. 154(b) by 553 days.

(21) Appl. No.: 12/997,344

(22) PCT Filed: Jun. 12, 2009

(86) PCT No.: PCT/EP2009/057310

§ 371 (c)(1),
(2), (4) Date: May 19, 2011

(87) PCT Pub. No.: WO2009/150234

PCT Pub. Date: Dec. 17, 2009

(65) Prior Publication Data

US 2011/0209491 A1 Sep. 1, 2011

(30) Foreign Application Priority Data

Jun. 12, 2008 (FR) ..... 08 03258

(51) Int. Cl.
*F25B 13/00* (2006.01)

(52) U.S. Cl.
USPC ..... 62/324.6; 62/510

(58) Field of Classification Search
CPC ..... F25B 30/00; F25B 30/06; F25B 13/00; F25B 1/10; F25B 2400/06; F25B 2400/075; F25D 17/06
USPC ..... 62/324.6, 238.7, 434, 324.1, 510
See application file for complete search history.

(56) References Cited

U.S. PATENT DOCUMENTS

| | | | | |
|---|---|---|---|---|
| 2,091,787 | A | | 8/1937 | Locke |
| 2,255,739 | A | * | 9/1941 | Curtis ..... 29/44 |
| 2,843,024 | A | * | 7/1958 | Armitage et al. ..... 409/106 |
| 2,956,454 | A | * | 10/1960 | Hansen ..... 408/13 |
| 2,994,021 | A | * | 7/1961 | Hinz ..... 318/663 |

(Continued)

FOREIGN PATENT DOCUMENTS

| | | | |
|---|---|---|---|
| DE | 20 2006 010412 | U1 | 9/2006 |
| EP | 1 788 325 | A1 | 5/2007 |
| WO | 02/39033 | A1 | 5/2002 |

OTHER PUBLICATIONS

International Search Report, dated Aug. 6, 2009, from corresponding PCT application.

*Primary Examiner* — Mohammad M Ali
(74) *Attorney, Agent, or Firm* — Young & Thompson

(57) ABSTRACT

A reversible system for recovery of heat energy by sampling and transfer of calories from one or more media into one or more other media of any type. The innovation is a new principle of refrigeration operation that makes it possible—with a nonreversible plate exchanger, a reversible plate exchanger, and a finned battery on an outside air circuit—to implement the following functions:

- total or partial restoration of calories on the nonreversible exchanger from the outside battery or from the reversible exchanger in evaporator mode,
- total or partial restoration of the calories on the reversible exchanger from the outside battery,
- refrigeration production on the reversible exchanger with total or partial evacuation of the calories on the nonreversible exchanger and/or on the outside battery.

19 Claims, 18 Drawing Sheets

(56) References Cited

U.S. PATENT DOCUMENTS

| | | | | |
|---|---|---|---|---|
| 3,126,713 | A * | 3/1964 | Parker | 62/117 |
| 3,885,938 | A * | 5/1975 | Ordonez | 62/196.2 |
| 4,189,929 | A * | 2/1980 | Russell | 62/175 |
| 4,418,548 | A * | 12/1983 | Sawyer | 62/175 |
| 4,926,652 | A * | 5/1990 | Kitamoto | 62/175 |
| 6,427,460 | B1 * | 8/2002 | Zanon | 62/174 |
| 6,453,691 | B1 * | 9/2002 | Seo et al. | 62/228.5 |
| 7,165,420 | B2 * | 1/2007 | Song et al. | 62/510 |

* cited by examiner

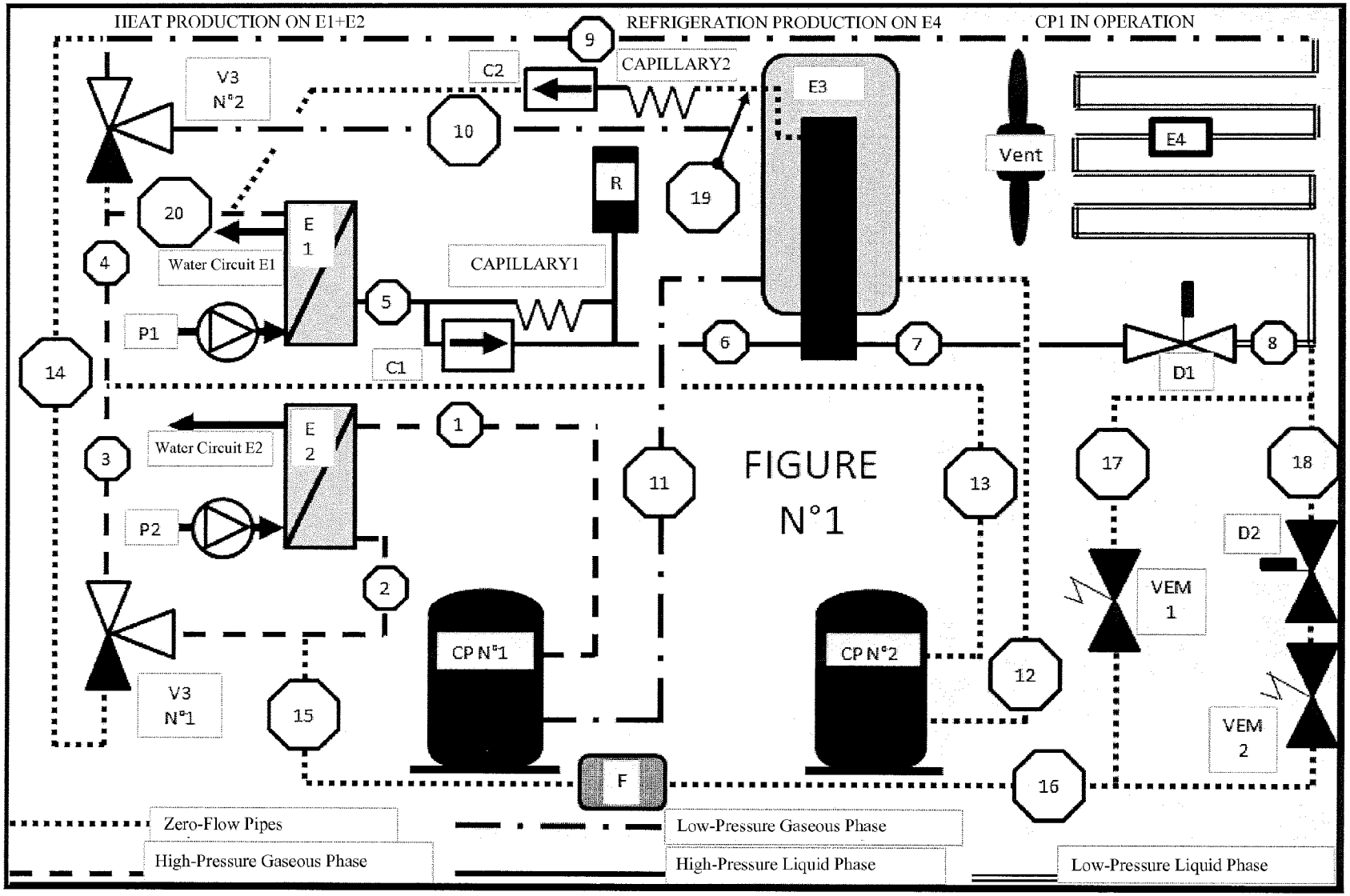
FIGURE N°1

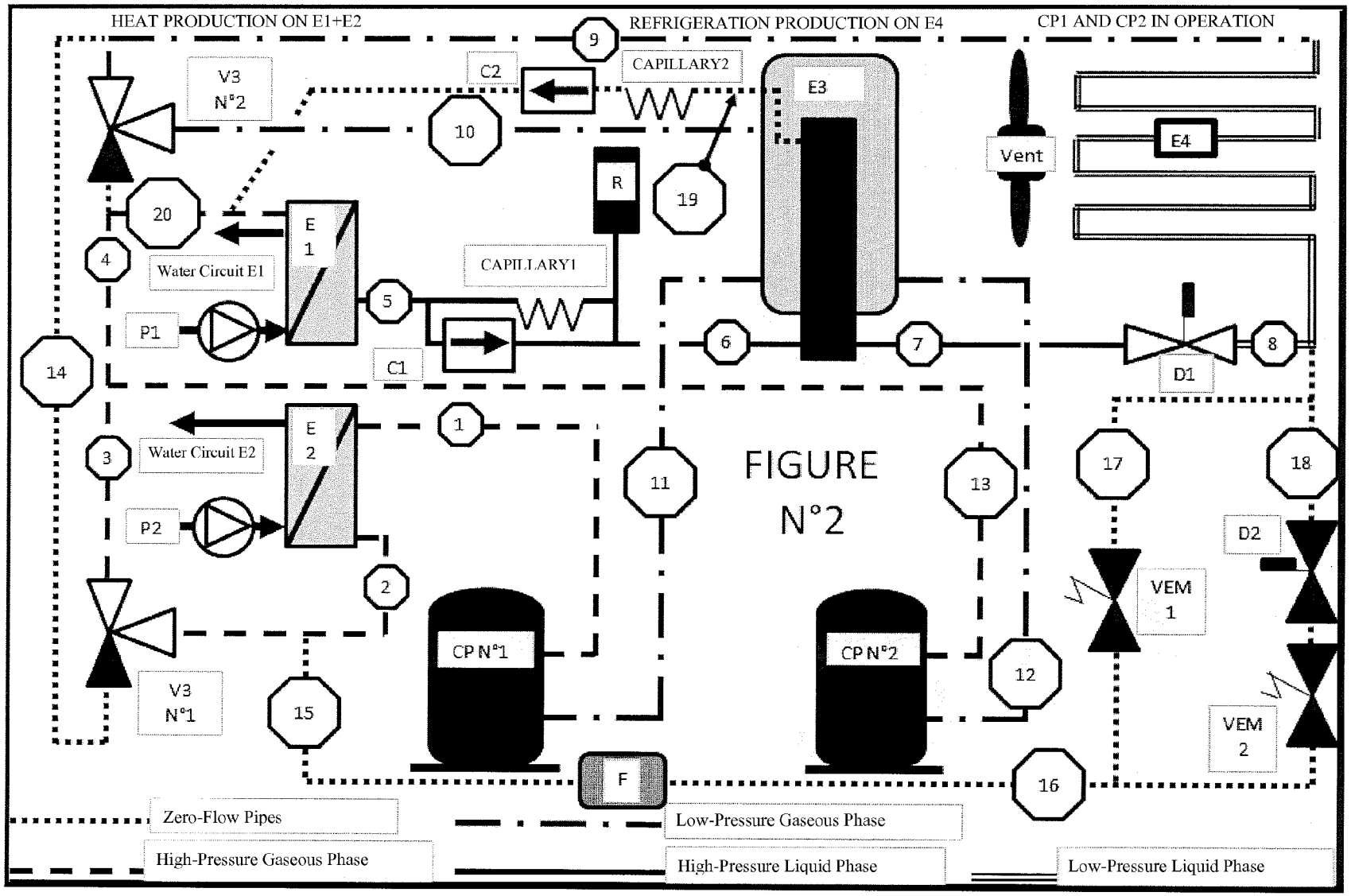
FIGURE N°2

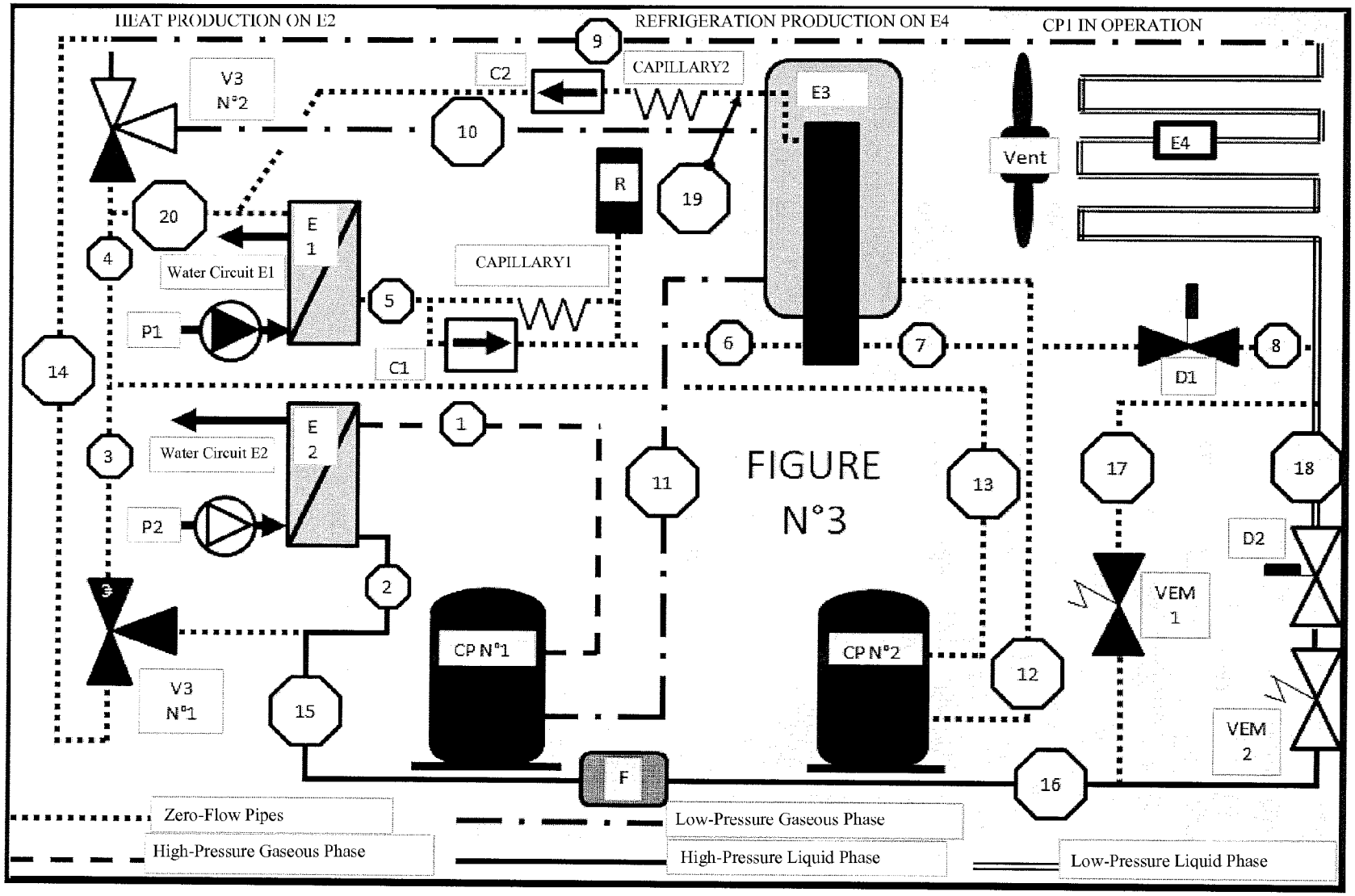
FIGURE N°3

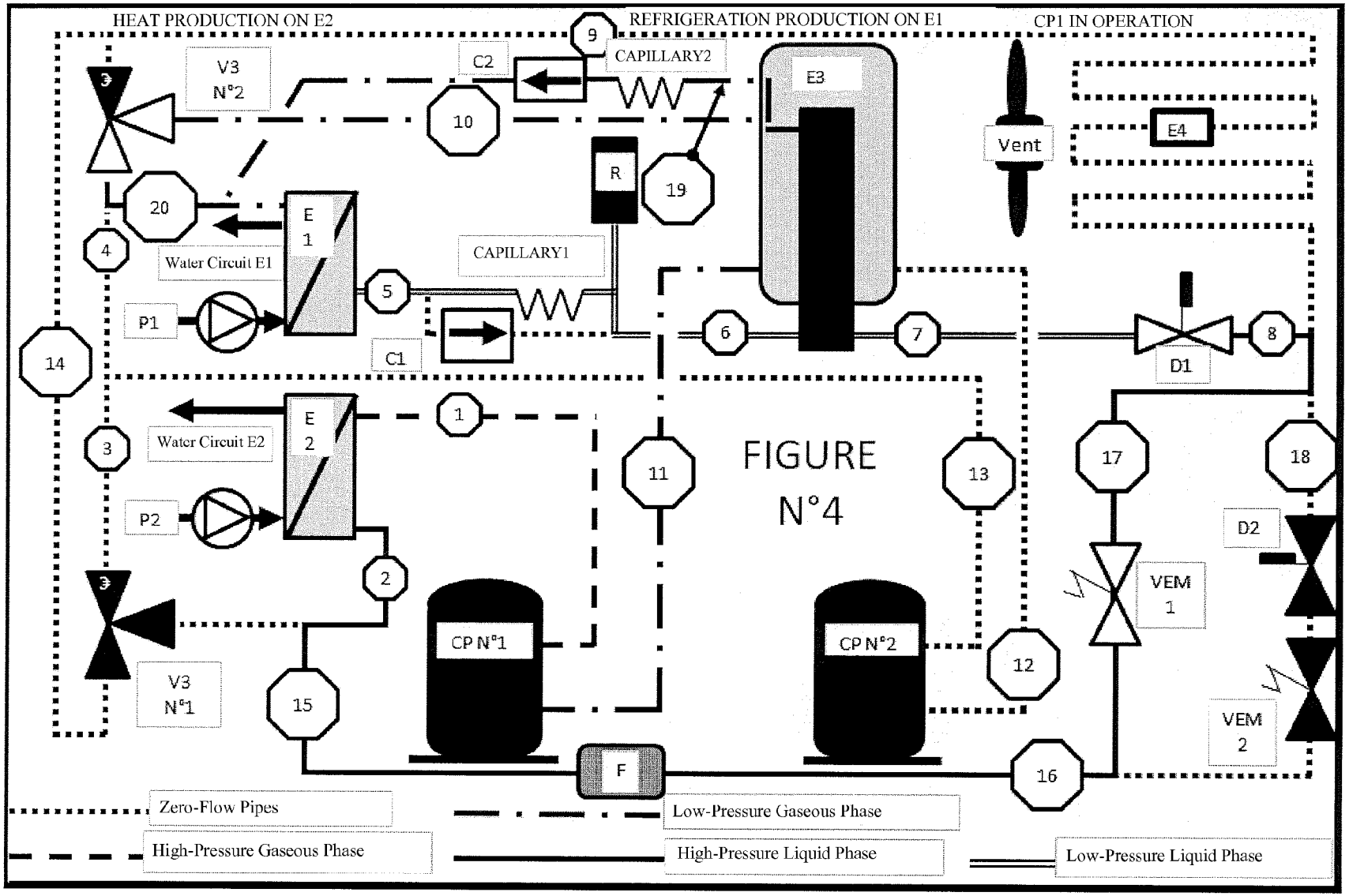
FIGURE N°4

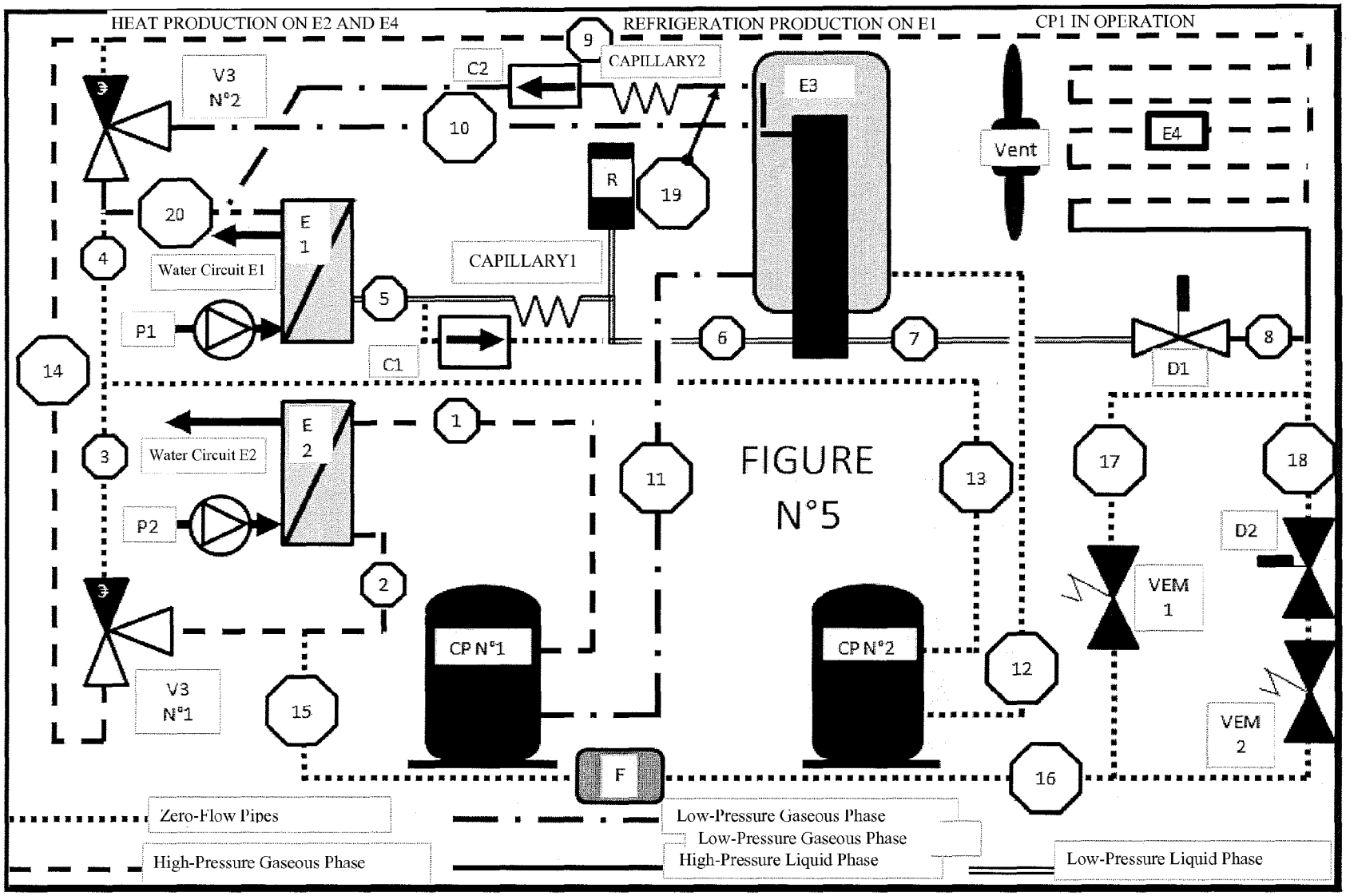
CP1 IN OPERATION
REFRIGERATION PRODUCTION ON E1
HEAT PRODUCTION ON E2 AND E4
Vent
E4
E3
D1
D2
VEM 1
VEM 2
CAPILLARY2
CAPILLARY1
R
C2
C1
E 1
E 2
Water Circuit E1
Water Circuit E2
P1
P2
V3 N°2
V3 N°1
CP N°2
CP N°1
F
FIGURE N°5
Low-Pressure Liquid Phase
Low-Pressure Gaseous Phase
Low-Pressure Gaseous Phase
High-Pressure Liquid Phase
Zero-Flow Pipes
High-Pressure Gaseous Phase

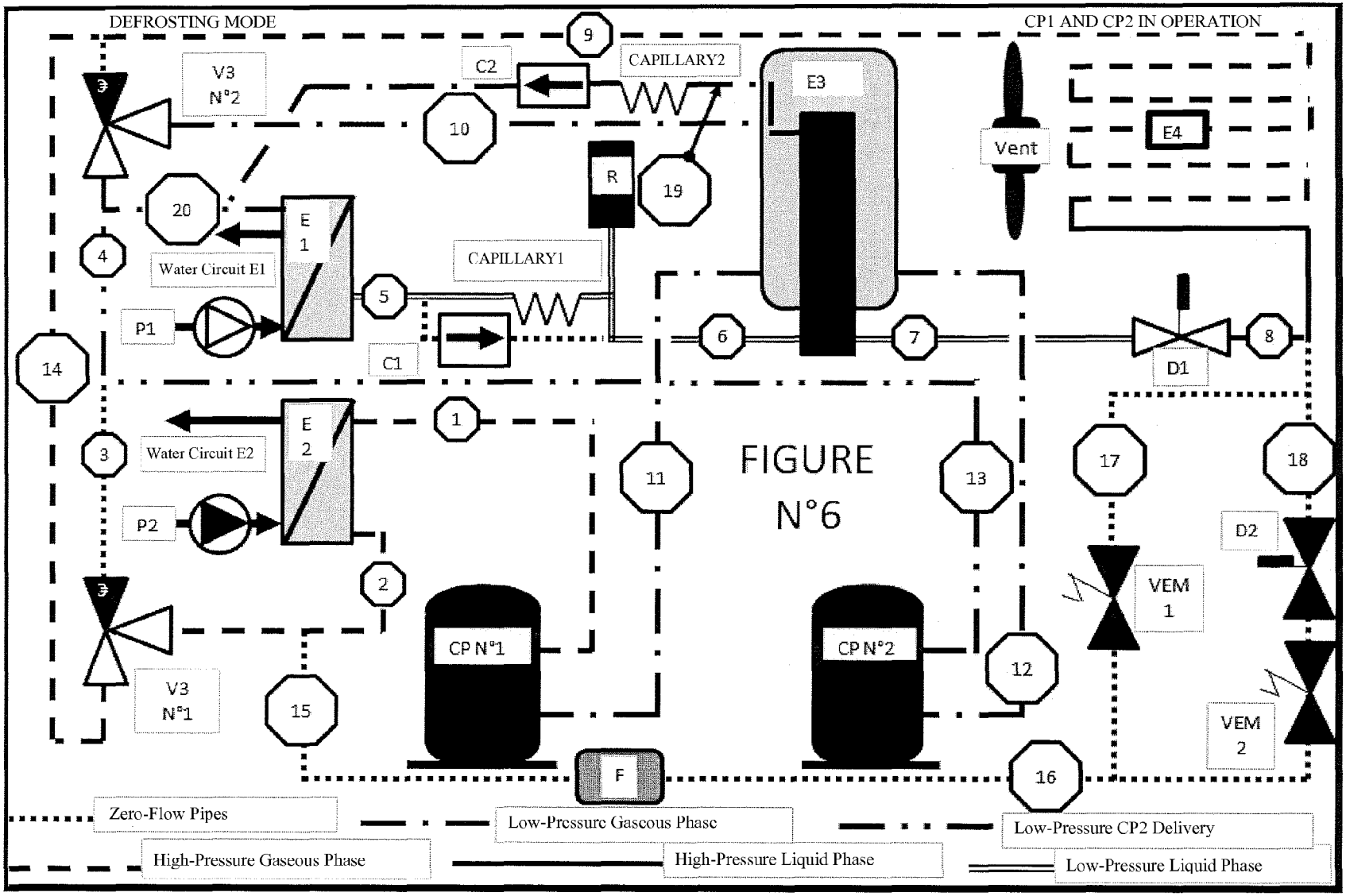
FIGURE N°6

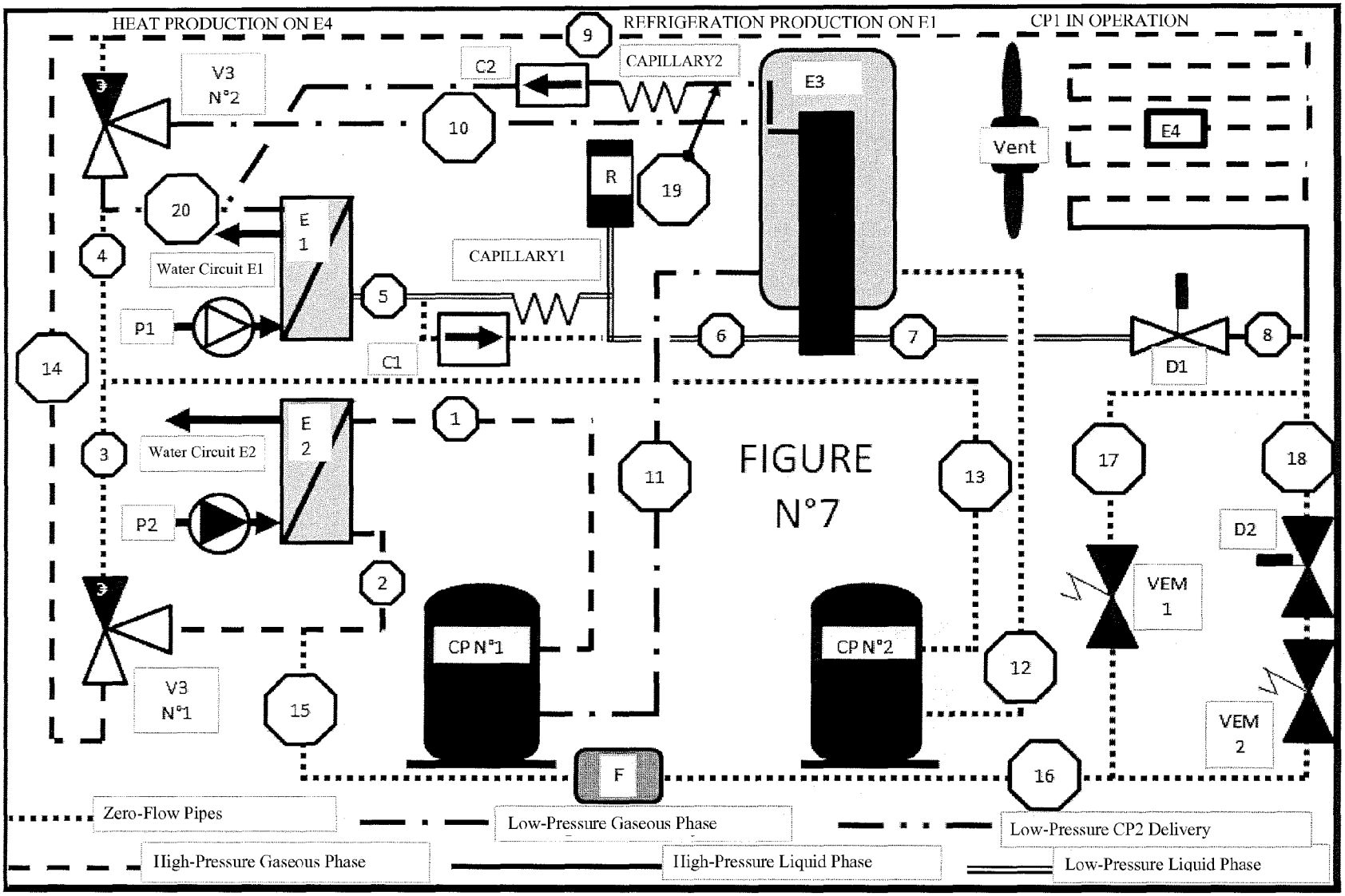
FIGURE N°7

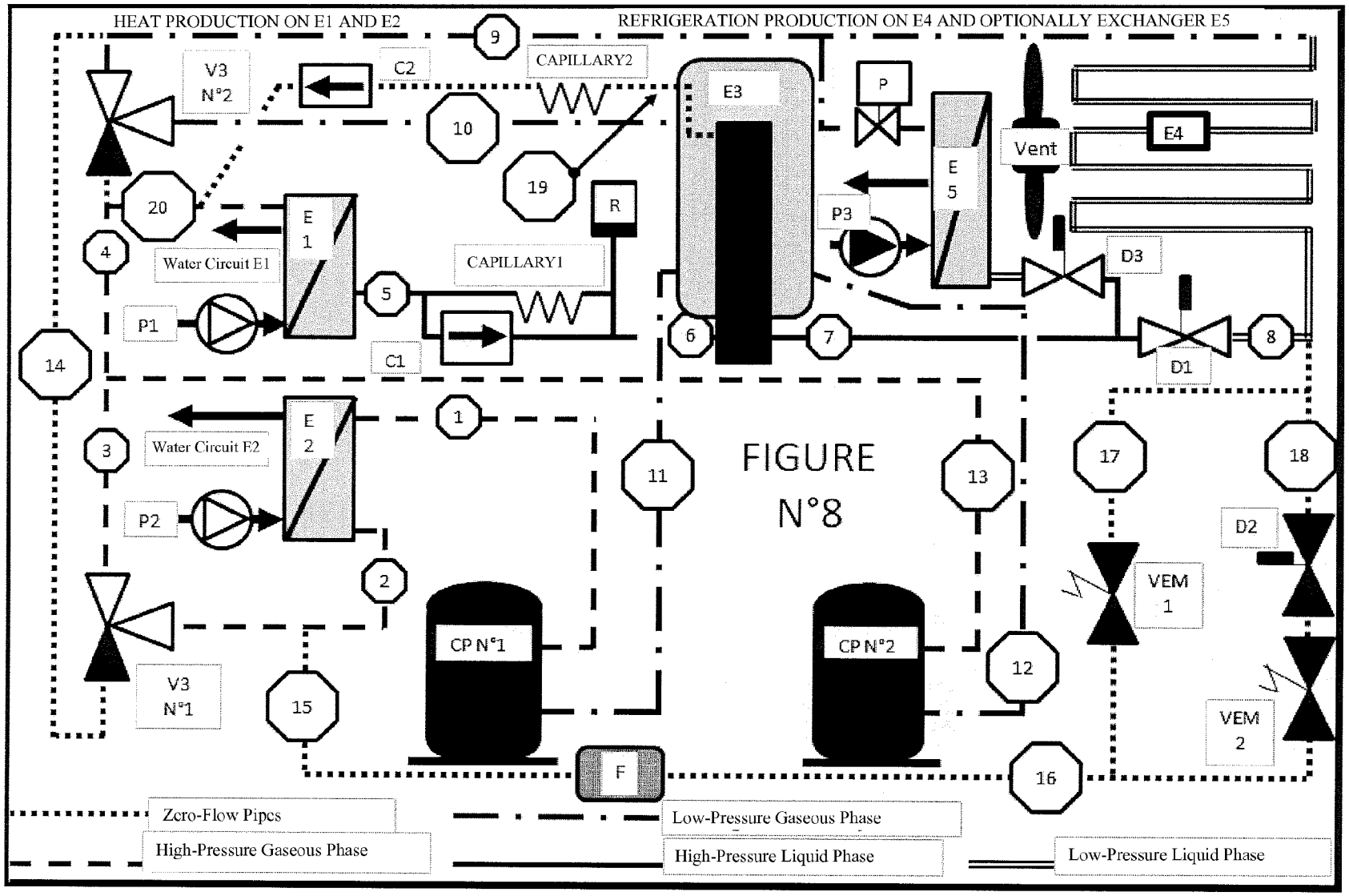
FIGURE N°8

FIGURE N°9
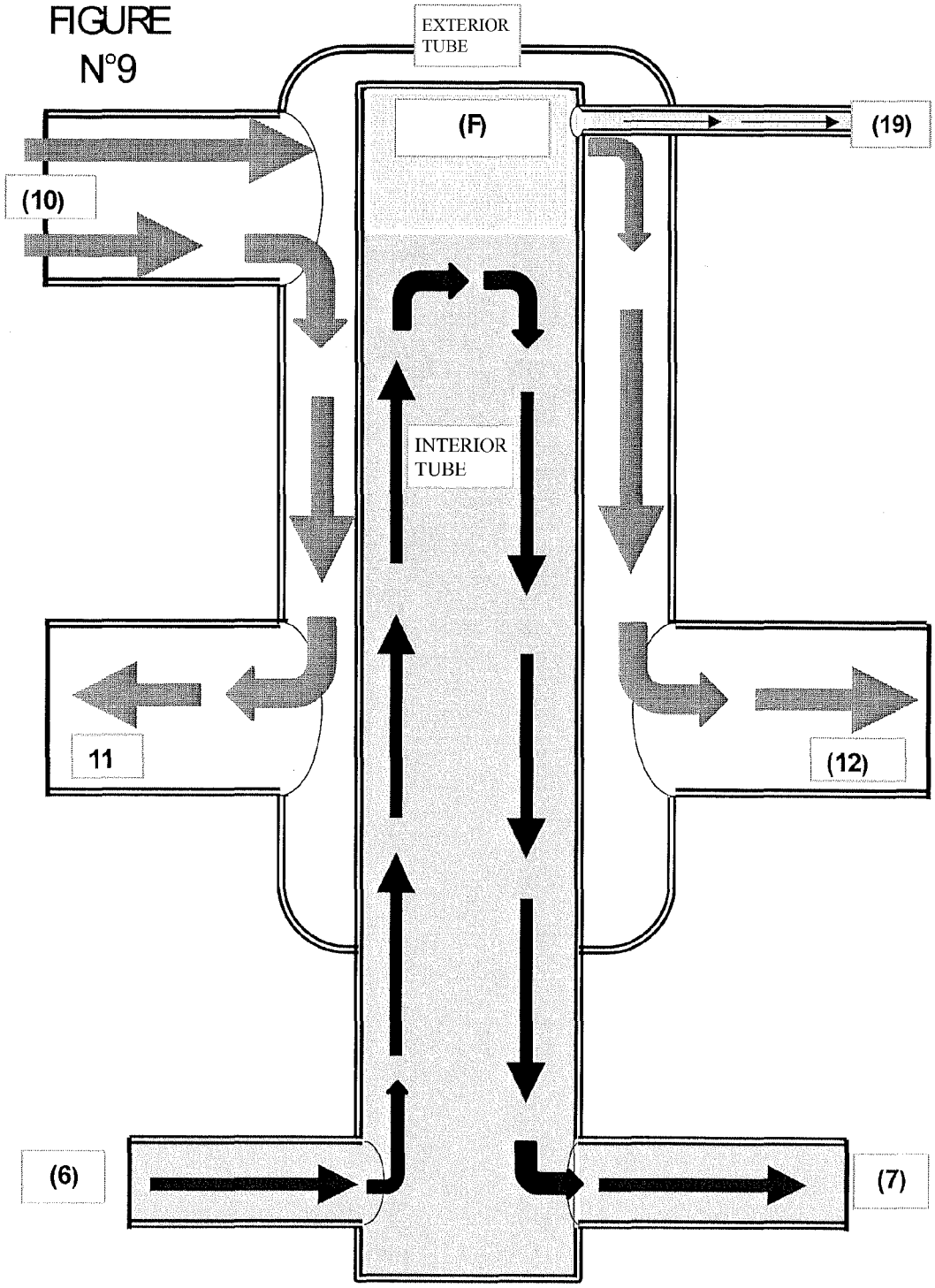

FIGURE N°10
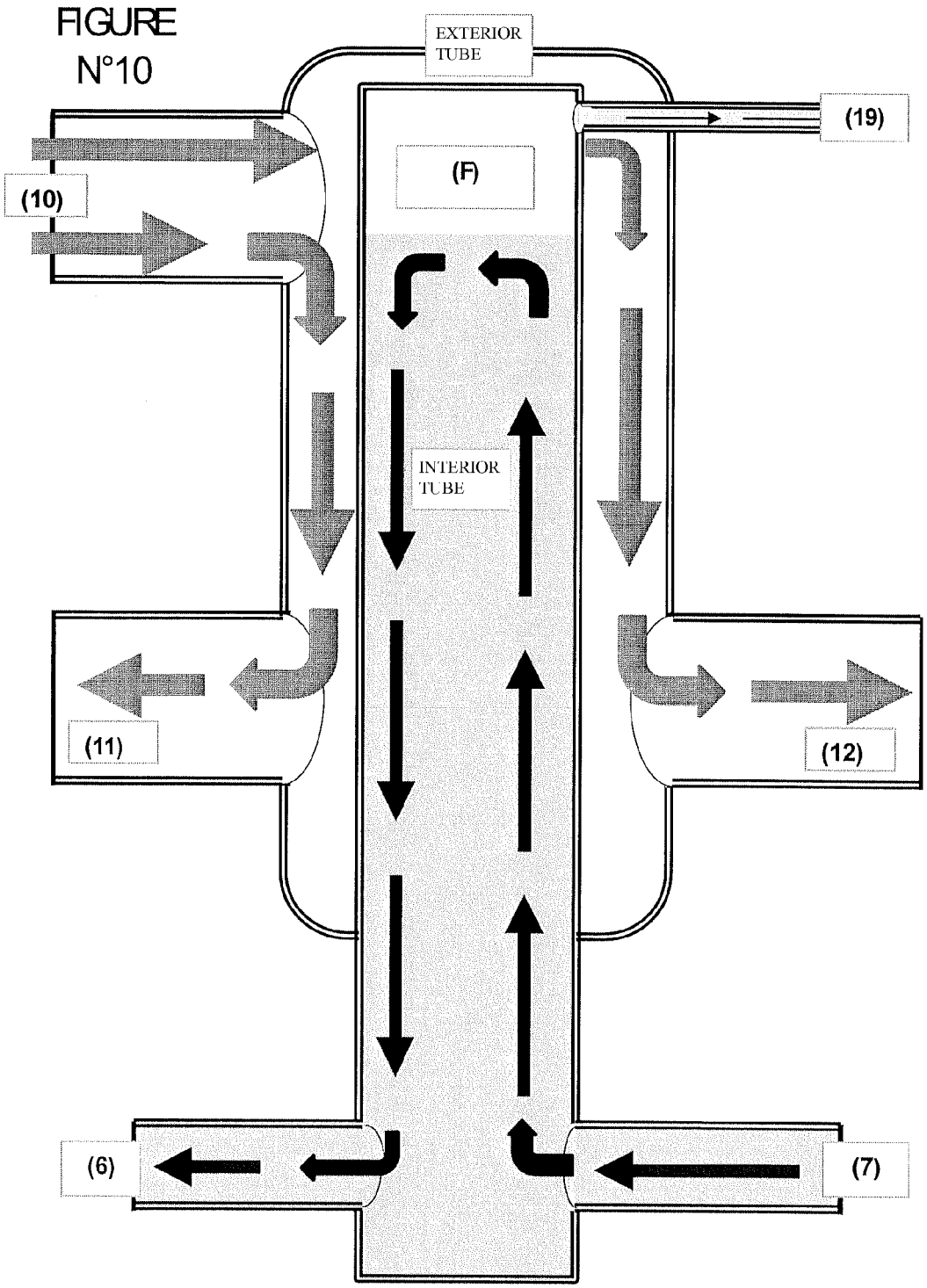

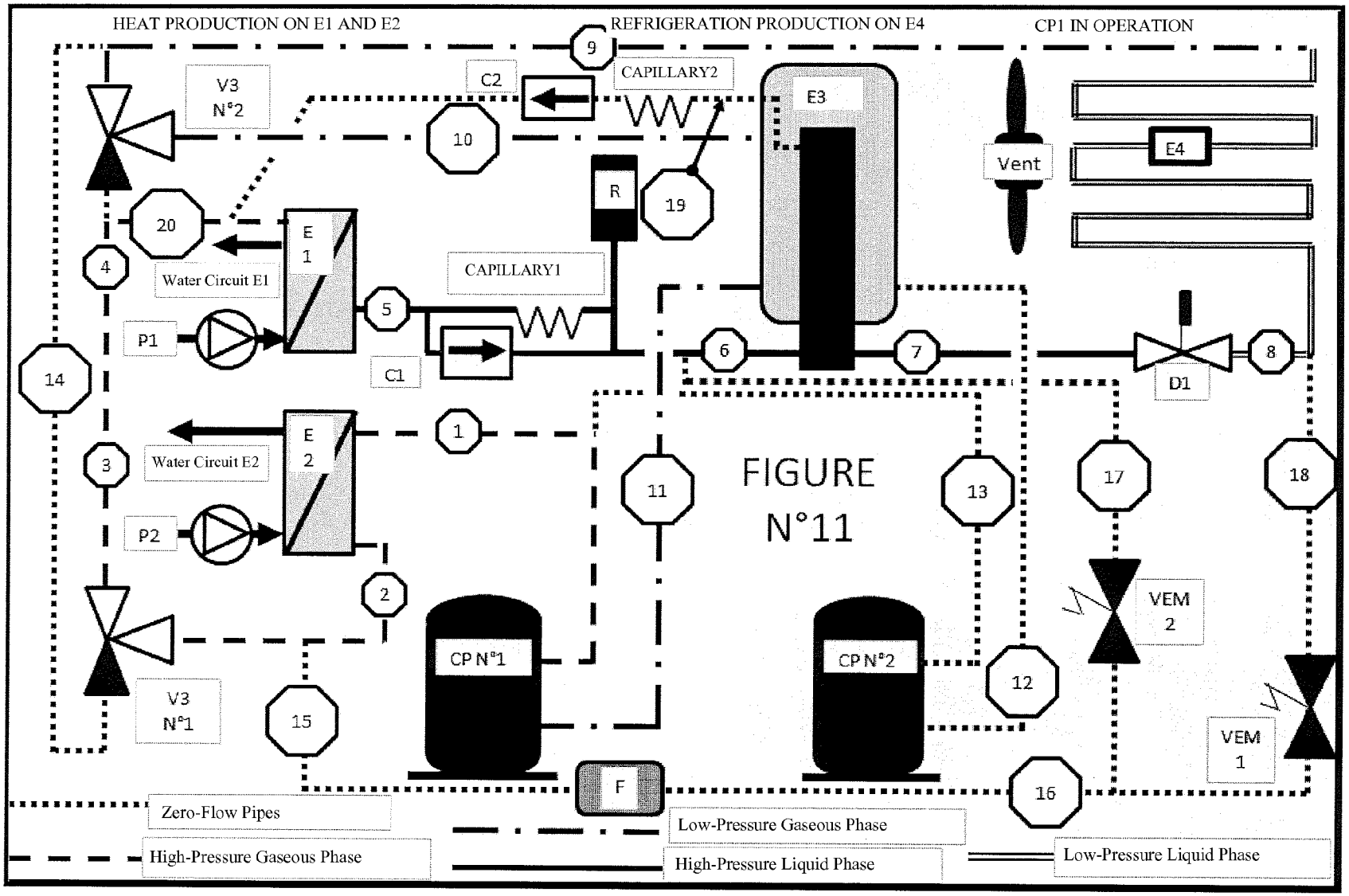
FIGURE N°11

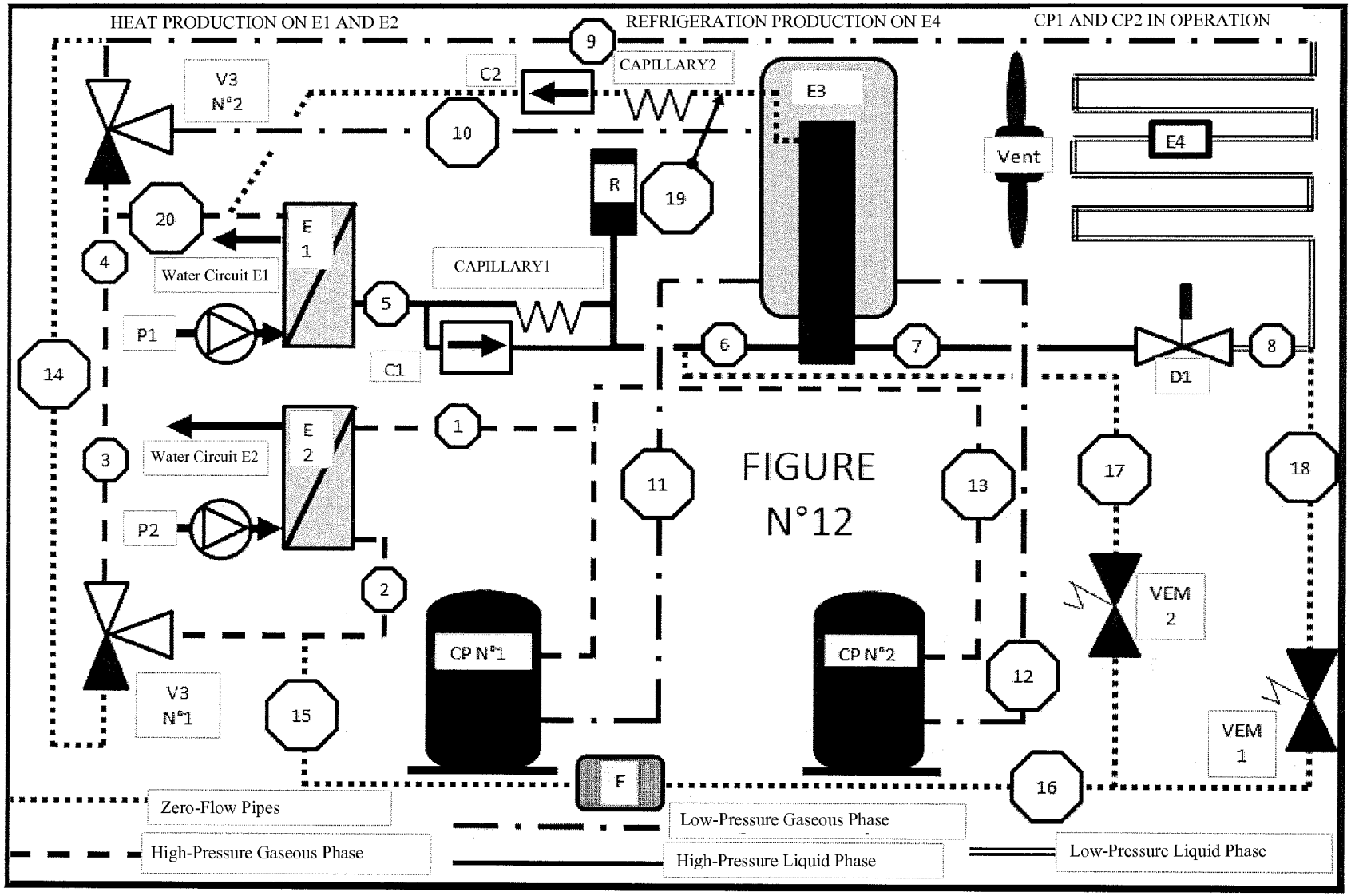
FIGURE N°12

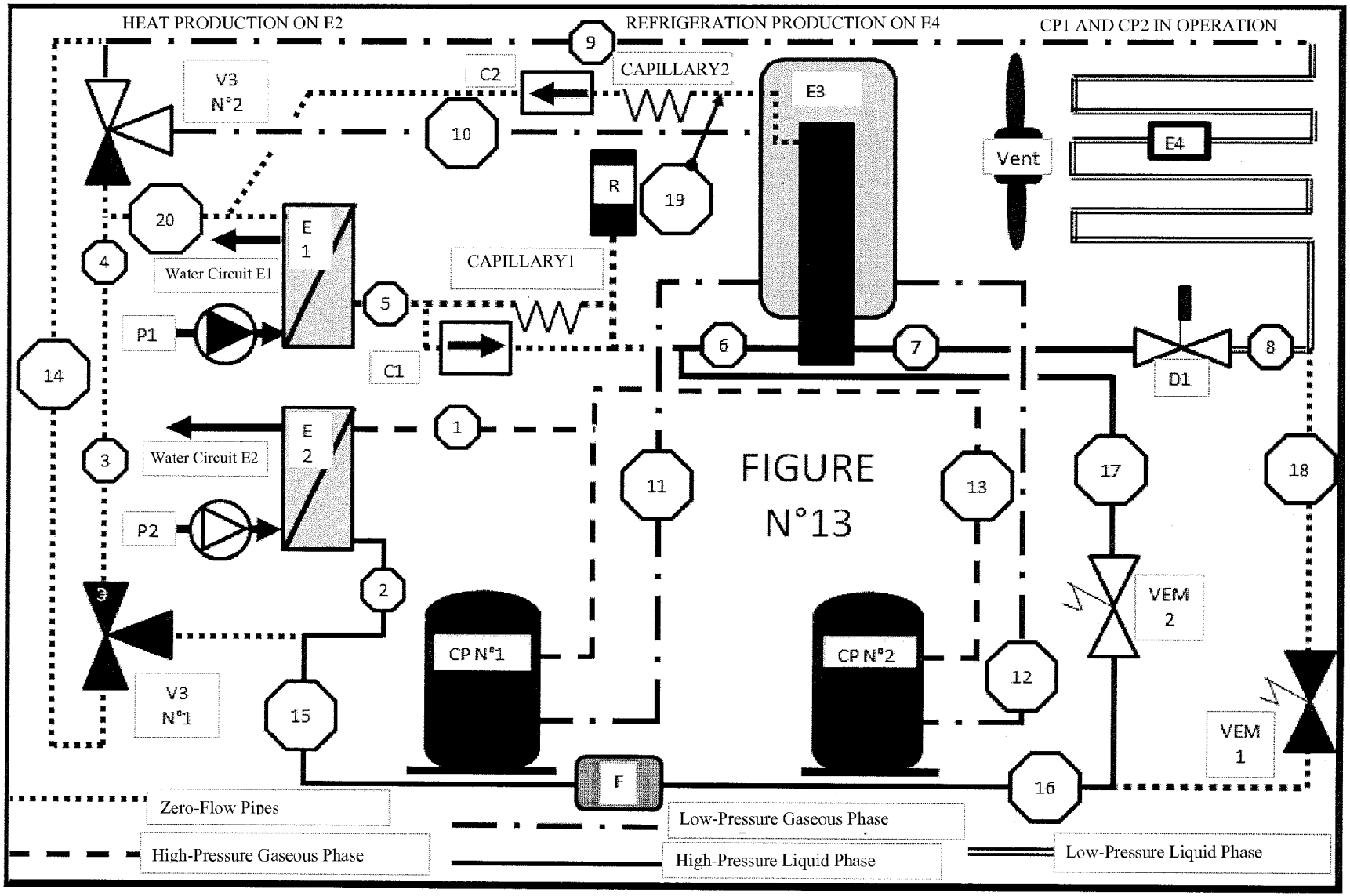
CP1 AND CP2 IN OPERATION
REFRIGERATION PRODUCTION ON E4
HEAT PRODUCTION ON E2
E4
Vent
D1
VEM 1
VEM 2
E3
CAPILLARY2
R
CAPILLARY1
C2
C1
E 1
E 2
Water Circuit E1
Water Circuit E2
P1
P2
V3 N°2
V3 N°1
CP N°2
CP N°1
F
Low-Pressure Liquid Phase
Low-Pressure Gaseous Phase
High-Pressure Liquid Phase
Zero-Flow Pipes
High-Pressure Gaseous Phase
FIGURE N°13
1
2
3
4
5
6
7
8
9
10
11
12
13
14
15
16
17
18
19
20

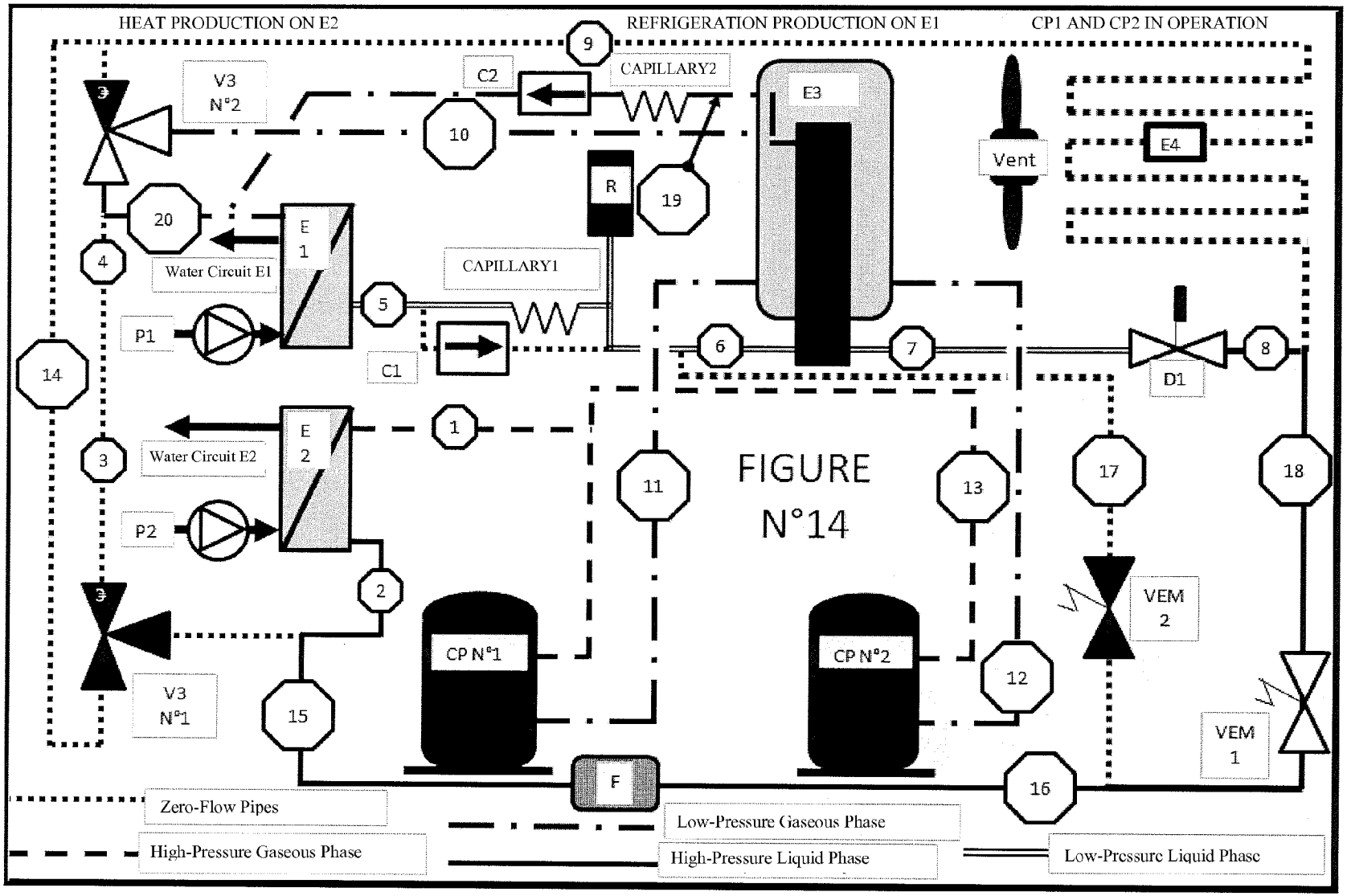
FIGURE N°14

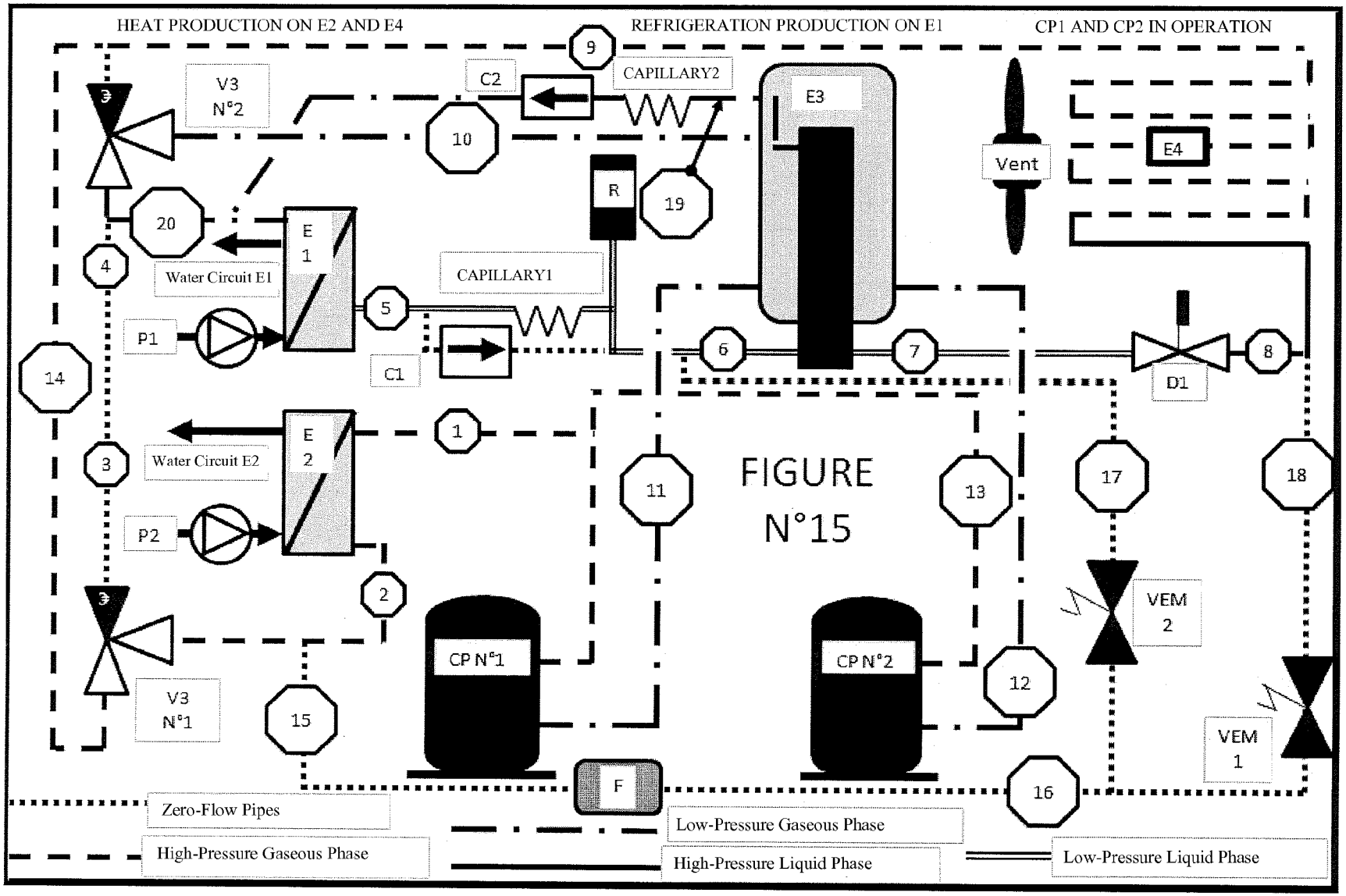
FIGURE N°15

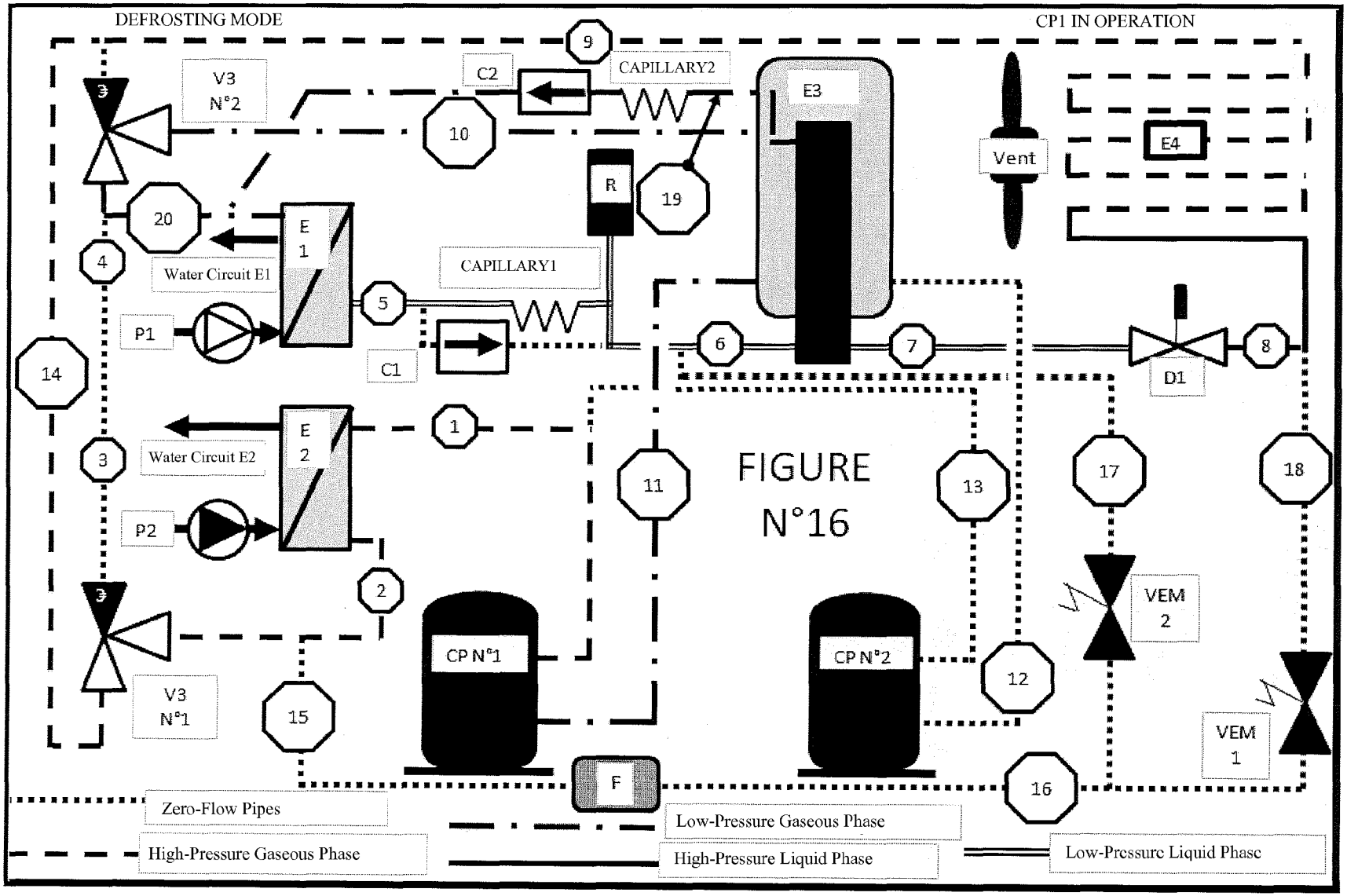
FIGURE N°16

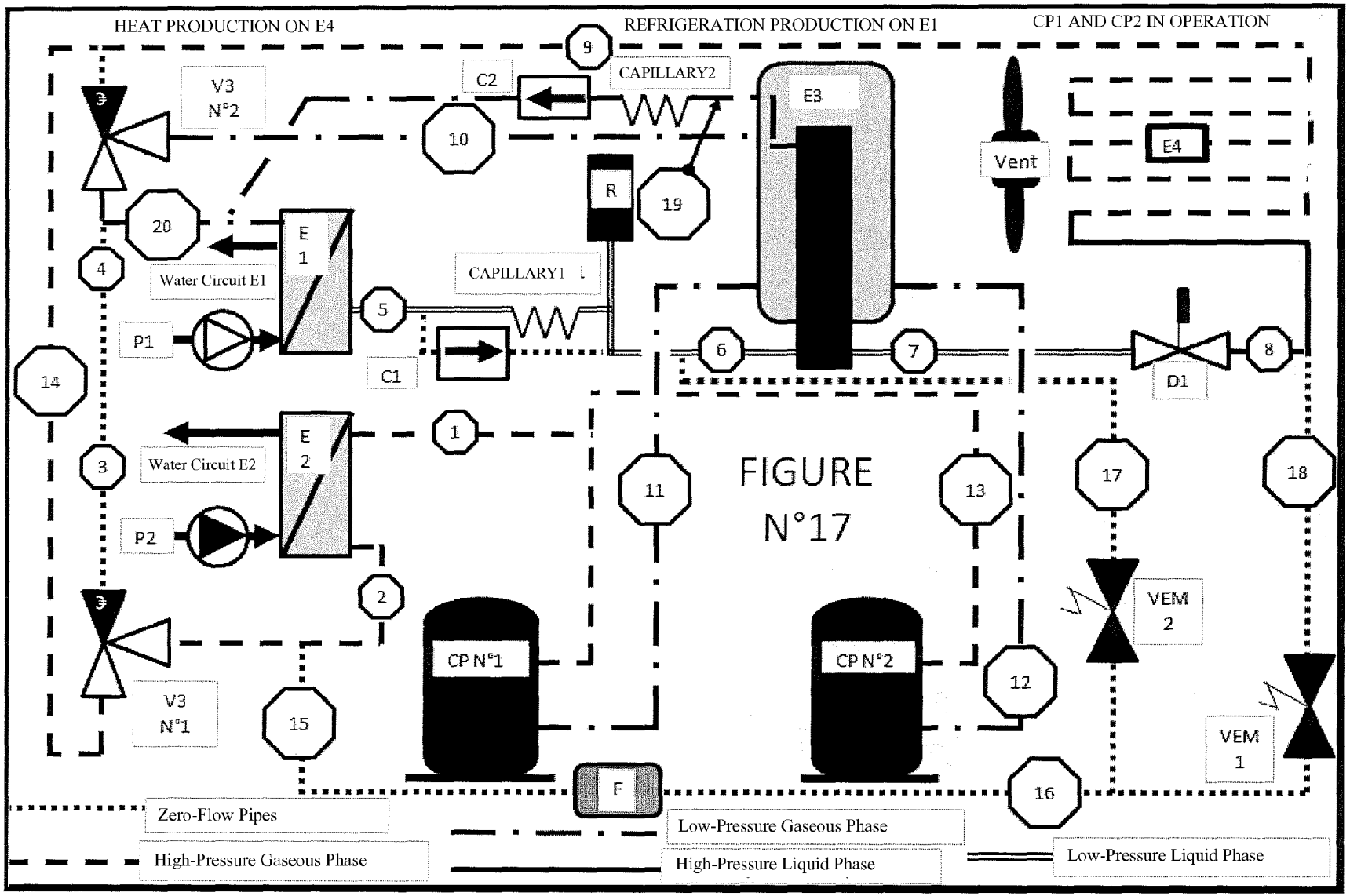
FIGURE N°17

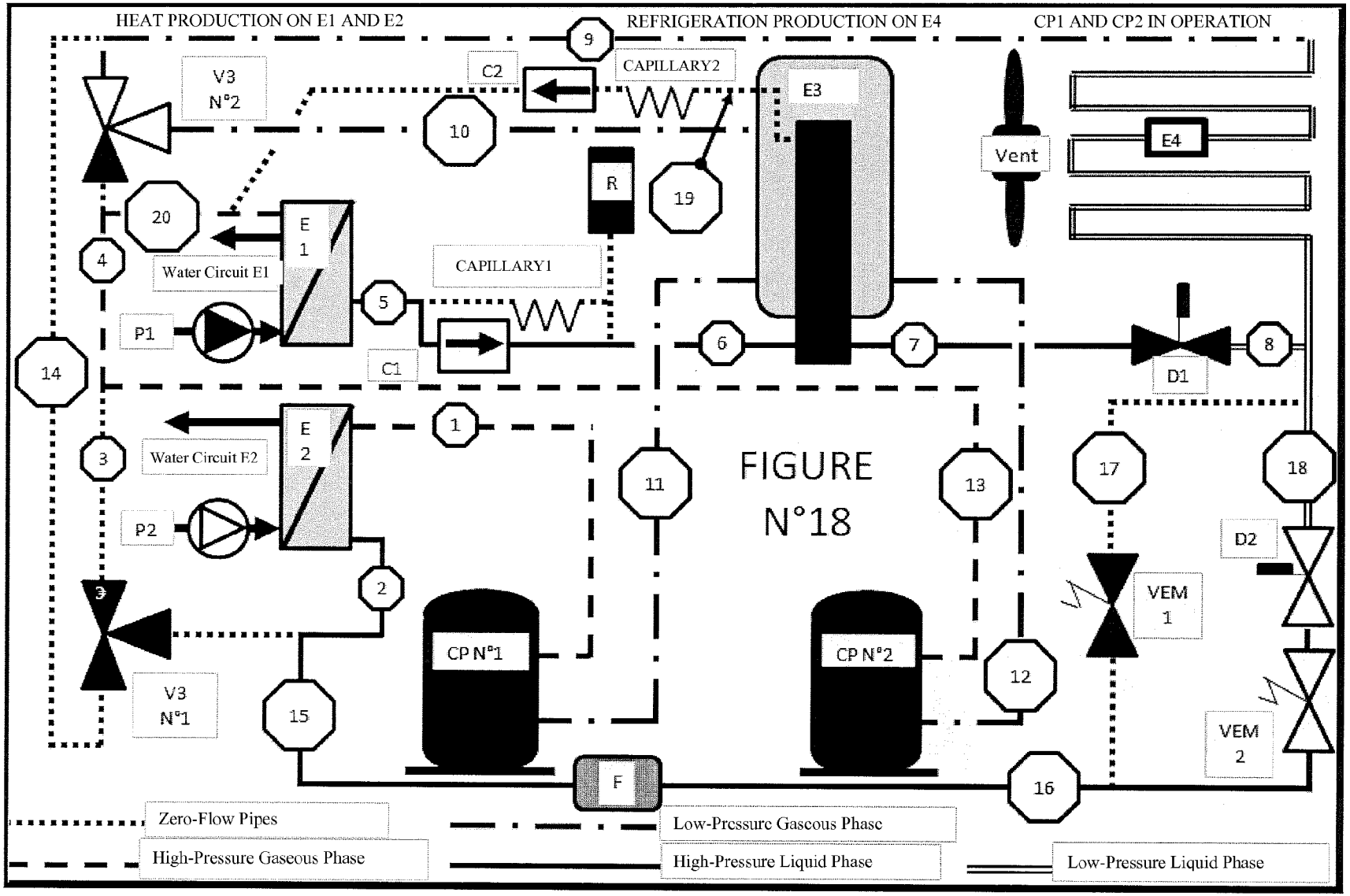
FIGURE N°18

REVERSIBLE SYSTEM FOR RECOVERING OF HEAT ENERGY BY SAMPLING AND TRANSFER OF CALORIES FROM ONE OR MORE MEDIA INTO ONE OR MORE OTHER SUCH MEDIA

BACKGROUND OF THE INVENTION

1. Field of the Invention

The invention relates to a reversible system for recovery by sampling and transfer of energy between at least two different media, for example between an outside medium and a biotope or between a biotope and another biotope.

2. Description of Related Art

The calorie requirements of cold periods of a living environment, workplace, or storage site are summarized by a quantity of calories that are devoted to heating. Other calorie requirements are necessary during the cold season and even beyond the latter: we can identify the production of hot water for domestic use that is to be ensured for the entire year, the heating of a swimming pool or other requirements in the industrial or tertiary field.

In air-conditioned sites, the extraction of excess calories from the building is to be ensured.

In conventional air-conditioning systems, the calories that are extracted from the building are often dissipated outside of the building and lost.

Currently, the heating of buildings is ensured by the combustion of fuel in boilers, by using the thermal energy of the sun, by using the Joule effect with electric boilers, or by using heat pumps that draw on the outside air or a source of free water for a large portion of their energy.

SUMMARY OF THE INVENTION

The invention uses an innovative technology in the field of reversible heat pumps.

The heat pumps are refrigerating machines that transfer heat from one medium to another by using as a vehicle a refrigerating fluid that passes successively from a gaseous state to a liquid state and vice versa by the succession of phases of compression and expansion.

Most of the systems are reversible; it is therefore possible to use these heat pumps for air-conditioning.

The heat pumps are connected to different types of terminals that may or may not be reversible, such as:

Radiators,

Heating/cooling floor,

Fan-convector units,

Air-treatment box.

The heat pumps and other energy recovery systems are characterized by a performance index (COP) that indicates the energy yield of the installation, the one being always greater than 1; the heat pumps therefore produce more heat energy than they consume electrical energy due to the energy that is drawn into the free recovery medium.

The technological progress of recent years has improved the yield of heat pumps because of the improvement of the components of the latter.

The invention proposes an improvement that deals with a new organization of the refrigeration circuit and the creation of components that have new functions, whereby the objective of the invention is to increase the yield and the reliability of the refrigeration system.

BRIEF DESCRIPTION OF THE DRAWING FIGURES

FIG. 1 shows the operation of the system with every other compressor in operation.

FIG. 2 shows the operation of the system with two compressors in operation.

FIG. 3 shows the operation of the system with every other compressor in operation and a heat production that is ensured on the exchanger E2.

FIG. 4 shows the operation of the system according to an embodiment of the invention.

FIG. 5 shows the operation of the system according to an embodiment of the invention.

FIG. 6 shows the operation of the system according to an embodiment of the invention.

FIG. 7 shows the operation of the system according to an embodiment of the invention.

FIG. 8 shows the operation of the system according to an embodiment of the invention.

FIG. 9 shows the operation of the system according to an embodiment of the invention.

FIG. 10 shows the operation of the system according to an embodiment of the invention.

FIG. 11 shows the operation of the system according to an embodiment of the invention.

FIG. 12 shows the operation of the system according to an embodiment of the invention.

FIG. 13 shows the operation of the system according to an embodiment of the invention.

FIG. 14 shows the operation of the system according to an embodiment of the invention.

FIG. 15 shows the operation of the system according to an embodiment of the invention.

FIG. 16 shows the operation of the system according to an embodiment of the invention.

FIG. 17 shows the operation of the system according to an embodiment of the invention.

FIG. 18 shows the operation of the system according to an embodiment of the invention.

DETAILED DESCRIPTION OF THE INVENTION

The innovation holds to the creation, the presence and the location in the installation of the following components:

At least one primary compressor (CP1) that is completed, if necessary, with one or more other compressors (CP2, CP3 . . . ), The presence of an exchanger E4 for the recovery or the evacuation of calories on the outside medium, whereby the exchanger E4 is a finned exchanger for the AIR/WATER-type heat pumps, or a plate exchanger, and even a multi-tubular or coaxial exchanger for the WATER/WATER heat pumps, A fluid/fluid exchanger E3 that is connected at the point 6 to the final expansion capillary 1 and to the reservoir R, to the point 7 of the BI-FLOW thermostatic expansion valve with outside equalization D1, to the point 19 of the capillary 2 for the limitation of the mass flow rate on this branch, to the intake point 10 of the cold gases that come from V3 No. 2, to the point 11, the intake of superheated gases by the compressor CP1, to the point 12, the intake of the superheated gases by the compressor CP2 (FIGS. 9 and 10).

The special feature of this exchanger E3 is to operate as a subcoolant of the liquid line when it is supplied with high-pressure fluid in the liquid state in its interior tube and also as a superheater of the intake gases in its exterior tube (FIGS. 1, 2, 8, 11, 12, 18).

In this case depicted, besides the organization of the fluid diagram, the refrigerating fluid reservoir R contains a high-pressure fluid reserve in the liquid state.

The other special feature of the fluid/fluid exchanger E3 is to operate as a degassing unit when it is supplied with low-pressure fluid in the liquid state in its interior tube and also as a superheater of the intake gases in its exterior tube (FIGS. 4, 5, 6, 7, 14, 15, 16, 17).

In this case depicted, besides the organization of the fluid diagram, the refrigerating fluid reservoir R contains a low-pressure fluid reserve in the liquid state with a variable ratio of fluid to the gaseous state.

The presence of three-way valves and three exchangers E1, E2 and E4 make possible the functions of desuperheater and condenser for the exchanger E2, and condenser and evaporator for the exchangers E1 and E4.

The presence and the location of the valves VEM1 and VEM2 make possible the operation of the exchanger E2 as condenser with either the exchanger E4 as evaporator or the exchanger E1 as evaporator.

The presence and the location of the expansion valve D2 increases the yield of the refrigerating fluid by allowing a different condensation pressure between the compressor CP1 and the compressor CP2 in the case of heat production on the exchanger E2 and on the exchanger E1 with the valve V3 No. 1 closed, and the two compressors CP1 and CP2 in operation (FIG. 18).

The arrangement of the different valves and expansion valves allows the possibility of managing the different exchangers in an insulated way and thus of being able to couple them in different combinations; this organization also makes possible the easy integration of one or more additional exchangers (Example in FIG. 8).

The invention makes it possible to oversize the energy recovery battery on the outside medium and to increase its yield (E4, FIGS. 1 to 18).

The invention also makes possible the installation of a non-reversible exchanger that can be used in desuperheater mode of the delivery gases of the compressor(s) or can be used in condenser mode for total restoration of the energy of the refrigerating fluid that is condensed in the latter, or can be used in partial condensation mode for partial restoration of the calories of the refrigerating fluid that passes through this exchanger.

This exchanger is called E2 and is connected to a hydraulic circuit for a distribution of heat energy to one or more media requiring calories; this exchanger is not reversible.

The invention also makes possible the installation of a reversible exchanger that can be used in condenser mode of the delivery gases of the compressor(s) for total restoration of the energy of the condensed refrigerating fluid in the latter, or it can be used in evaporator mode for total evacuation of the refrigeration energy of the refrigerating fluid that passes through this exchanger. This exchanger is called E1 and is connected to a hydraulic circuit for a heat or refrigerating energy distribution to one or more media requiring calories or negative kilogram calories.

The invention also makes it possible for the exchanger E1 to recover heat energy that is not absorbed by the exchanger E2 when the latter is in desuperheater mode or if E2 is in partial condensation mode.

By the presence of these two exchangers E1 and E2 and without adding additional regulations or other mixing valves on the hydraulic circuits, we therefore have available a heat pump that is equipped with two hydraulic circuits:

A non-reversible hydraulic circuit E2 for the distribution of calories drawn from the outside exchanger E4 or from the exchanger E1 that operates in evaporator mode.

A reversible hydraulic circuit E1 for the distribution of calories drawn on the exchanger E4 and also this same circuit for the distribution of chilled water and an evacuation of calories to the exchanger E2, E4, or E2+E4.

The invention therefore makes possible the function of energy transfer, which means the possibility of recovering calories on the exchanger E1 in evaporator mode for the production of chilled water on the hydraulic circuit E1 and simultaneously the restoration of these calories for the heating of the hydraulic circuit E2 via the exchanger E2 in condenser mode or in desuperheater mode, or for an electrical consumption of 1 kw, a refrigeration production of 3.5 KW, and a heat production of 4.5 KW with a single machine.

This function is useful and very economical when a building is air-conditioned and when there is a simultaneous demand for heat production for the production of hot water for domestic use or the heating of a swimming pool.

To allow these functions and to improve the energy yield of the unit, certain refrigeration components have been created, and others have been used according to an innovative refrigeration diagram.

Among the elements created, we have a fluid/fluid exchanger E3. It consists of an inside cylinder that only empties into three taps No. 6, No. 7 and No. 19 (FIGS. 9 and 10), and an outside cylinder that empties into three taps No. 10, No. 11 and No. 12 (FIGS. 9 and 10).

No flow of fluid passes from the inside cylinder to the outside cylinder or from the outside cylinder to the inside cylinder.

The fact that the inside cylinder has been placed in the outside cylinder is only used to produce a heat exchange between the cold refrigerating fluid that passes through the exterior tube before being drawn in by the compressor(s) and the warmer refrigerating fluid that passes through the interior tube.

The heat exchange is done by the wall of the interior tube in the cross-section that is in contact with the refrigerating fluid that is contained in the exterior tube.

The tube with a small cross-section at the point 19 has the function of evacuating a portion of the fluid in the gaseous state that is created by the expansion by the expansion valve D1 when the latter is passed through from the point 8 to the point 7.

In this case depicted, the inside cylinder is supplied with low-pressure liquid refrigerating fluid with a minority ratio of fluid to the gaseous state.

The tube with a small cross-section at the point 19 has the function of reducing the ratio of fluid to the gaseous state by evacuating it from the interior tube at the point 19 to the point 20. The capillary 2 has the function of limiting the flow rate from the point 19 to the point 20 so as not to evacuate the fluid in the liquid state.

The differential heads of this capillary should be calculated so that the volume of refrigerating fluid in the gaseous state that is evacuated from the point 19 to the point 20 is less than the volume of refrigerating fluid in the gaseous state that is generated by the expansion valve D1 when the fluid passes through it from the point 8 to the point 7.

Thus, we will use a fluid with a smaller ratio of refrigerating fluid in the gaseous phase at the point 6 when E1 is in evaporator mode; this will increase the effectiveness of the exchanger E1 because of a better supply of liquid.

In the case where the refrigerating fluid passes through the expansion valve D1 from the point 7 to the point 8 (FIGS. 1, 2, and 8), the fluid/fluid exchanger E3 is an innovative piece of refrigeration equipment that has as its function to subcool the high-pressure liquid and to superheat the intake gases when the exchanger E1 is in condenser mode.

With the diameter of the inside cylinder being at least 4 times larger than the liquid pipe at the points 6 and 7 (FIGS. 9 and 10), the high-pressure fluid in gaseous form will inevitably be recovered for the most part at the top of the inside cylinder, and a portion of this fluid will be condensed by the negative kilogram calories recovered on the intake gases that pass through the outside cylinder.

The absence of four-way valves, the presence and the placement of the two-way and three-way valves 2, the placement of the two expansion valves, the presence and the placement of a capillary, and the placement of two expansion valves make an innovative fluid diagram.

So as to better understand the operation of this system, it is necessary to refer to FIGS. 1 to 18 that show the state and the routing of the refrigerating fluid based on the requirements of negative kilogram calories or calories of the different exchangers.

For FIGS. 1 to 8 and 11 to 18, the pipes have been shown in the following way:

- The insulated refrigeration pipes that have a zero refrigerating fluid flow rate are indicated by dots.
- The refrigeration pipes through which a flow of high-pressure refrigerating fluid that is the gaseous state passes are indicated by small dashes.
- The refrigeration pipes through which a flow of high-pressure refrigerating fluid that is in the liquid state passes are indicated by solid lines.
- The refrigeration pipes through which a flow of low-pressure refrigerating fluid that is in the liquid state passes are indicated by double lines.
- The refrigeration pipes through which a flow of low-pressure refrigerating fluid that is in the gaseous state passes are indicated by dotted lines.
- The solenoid valves are indicated by two opposing triangles that are black if the solenoid valve is closed and white if the solenoid valve is open.
- The expansion valves are indicated by two opposing triangles that are black if the expansion valve is closed, and white if the expansion valve is open and passing.
- The three-way valves are indicated by three opposing triangles that are black if the three-way valve is closed and white if the three-way valve is open by indicating which the passing branches are.

The plate exchangers are supplied with water by circulators that pulse the water through the latter.

- The circulators P1 and P2 are indicated by a triangle in a circle, a triangle that is oriented in the direction of water flow and encompassed in a circle:
  - If the triangle is white, this means that the circulator is in operation and that the water is passing through the exchanger that is connected thereto.
  - If the triangle is black, this means that the circulator is not operating and that the exchanger that is connected to the latter is not supplied with water.

FIG. 1 shows the operation of the system with every other compressor in operation and a heat production that is ensured on the exchangers E1 and E2. The compressor CP1 compresses and delivers the refrigerating fluid to the point No. 1.

For example, we can have a reference temperature at the point No. 1 of 90° C.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2.

For example, we can have a temperature of the water circuit at the inlet of 45° C. and at the outlet of 48° C.

The refrigerating fluid that leaves the exchanger E2 at the point 2 is therefore colder than at the point No. 1.

For example, we can have a reference temperature at the point No. 2 of 45° C.

The refrigerating fluid passes through the valve V3 No. 1, the point No. 3, the point No. 4, and the point No. 20 to then return to the exchanger E1.

With the water that passes through the exchanger E1 being colder than the fluid, the calories leave the fluid for the water circuit E1.

The refrigerating fluid condenses in the exchanger E1 and exits from the latter in high-pressure liquid form at the point No. 5.

For example, we can have a condensation temperature of 36° C., a temperature of the water circuit E1 at the inlet of 33° C. and at the outlet of 35° C.

The fluid passes through the nonreturn valve C1, and the point 6, and it returns to the inside cylinder of the fluid/fluid exchanger E3.

For example, at the point 6, the temperature of the fluid is 35° C.

The high-pressure condensed fluid is subcooled in the exchanger E3 and exits at the point 7.

For example, the temperature at the point 7 will be 30° C. or a subcooling of 5° C. by the exchanger E3.

The fluid passes through the expansion valve D1 where it is expanded and therefore in low-pressure liquid form with a minority ratio in the gaseous phase at the point 8.

For example, the temperature of the fluid at the point 8 is −15° C.

The fluid passes through the exchanger E4 that is ventilated by the ventilator VENT.

The fluid enters into boiling by evacuating the negative kilogram calories into the passing air E4.

The refrigerating fluid leaves E4 at the point 9 in low-pressure gaseous form.

For example, the temperature of the fluid at the point 9 will be −10° C.

The fluid passes through V3 No. 2 for the point 10.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is −5° C.

FIG. 2 shows the operation of the system with two compressors in operation and a heat production that is ensured on the exchangers E1 and E2.

The presence of the exchanger E3 in this case depicted is innovative because it is placed on a high-pressure liquid cross-section of the refrigeration circuit that is not always supplied with high-pressure liquid in its interior tube.

The innovative design and location of the exchanger E3 allow this element to have functions that are different from those of requirements of calories and negative kilogram calories of the different exchangers that are installed.

In FIG. 1, the exchanger E3 is used as a superheater of intake gases, a subcooler of high-pressure liquid upstream from the expansion valve D1, and it makes it possible to store a large quantity of fluid in the liquid state in its interior tube.

The superheating of the intake gases and the subcooling of the liquid upstream from the expansion valve D1 make it possible to increase the percentage of fluid in the liquid state in the exchanger E4 and therefore to increase the mean coefficient of conductivity of the exchanger E4, or a gain for the energy yield of the unit.

The operation that is described in FIG. 2 is close to the operation that is described in FIG. 1; the differences are described below:

Increase of the mass flow rate of fluid because of the activation of the compressor No. 2.

Compression and delivery of the fluid at the point 13 and mixing of this flow with the flow of the first compressor at the point No. 4.

For example, the high-pressure fluid temperature at the point 13 is 90° C.

Because the mixture of the gaseous stream that comes from the compressor No. 1 has a temperature of 45° C. and the gaseous stream that comes from the compressor No. 2 has a temperature of 90° C., the mixture of the two streams will have a temperature of 67.5° C. if the mass flow rate of the two compressors is identical.

In this case, the calories of the compressor No. 2 will be evacuated exclusively by the exchanger E1 on behalf of the water circuit E1.

For example, because of the increase of the heat power dissipated on exchanger E1, the condensation temperature increases to 40° C. and the water of the hydraulic circuit No. 1 enters at 33° C. and exits at 38° C.

The fluid passes through the nonreturn valve C1, the point 6, and it returns to the inside cylinder of the fluid/fluid exchanger E3.

For example, at the point 6, the temperature of the fluid is 40° C.

The high-pressure condensed fluid is subcooled in the exchanger E3 and exits at the point 7.

For example, the temperature at the point 7 will be 35° C., or a subcooling of 5° C. by the exchanger E3.

The fluid passes through the expansion valve D11 where it is expanded and therefore in low-pressure liquid form with a minority ratio in the gaseous phase at the point 8.

For example, the temperature of the fluid at the point 8 is −18° C.

The fluid passes through the exchanger E4, which is ventilated by the ventilator VENT.

The fluid enters into boiling by evacuating the negative kilogram calories into the passing air E4. The refrigerating fluid leaves E4 at the point 9 in low-pressure gaseous form.

For example, the temperature of the fluid at the point 9 will be −13° C.

The fluid passes through V3 No. 2 for the point 10. The fluid returns to the exterior tube of the exchanger E3 and is superheated upon contact with the interior tube of the exchanger E3. The fluid leaves the exchanger E3 at the points 11 and 12 and is drawn in by the compressors CP1 and CP2.

For example, the temperature of the fluid at the point 12 is −8° C.

The functions of the exchanger E3 are identical for FIGS. 1 and 2.

FIG. 3 shows the operation of the system with every other compressor in operation and a heat production that is ensured on the exchanger E2.

The compressor CP1 compresses and delivers the refrigerating fluid to the point No. 1.

For example, we can have a reference temperature at the point No. 1 of 110° C.

The fluid passes through the exchanger E2, which is a plate exchanger that is irrigated with water by the circulator P2 for the distribution of calories. The fluid that passes through the exchanger E2 is at high pressure and high temperature. With the water that passes through the exchanger E2 being colder than the fluid, the calories leave the fluid for the water circuit E2. In this case depicted, the fluid is condensed at 100% in the exchanger E2.

For example, we can have a temperature of the water circuit at the inlet of 60° C. and at the outlet of 65° C. with a condensation temperature of 65° C.

The refrigerating fluid that leaves the exchanger E2 at the point 2 is therefore condensed and is colder than at the point No. 1.

For example, we can have a reference temperature at the point No. 2 of 64° C.

With the valve V3 No. 1 being closed, the refrigerating fluid passes through the point 15, the filter F, the point 16, the valve VEM2, and the expansion valve D2.

The fluid that passes through the expansion valve D2 is expanded and is therefore in low-pressure liquid form with a minority ratio in the gaseous phase at the point 18.

For example, the temperature of the fluid at the point 18 is −15° C.

The fluid passes through the exchanger E4, which is ventilated by the ventilator VENT.

The fluid enters into boiling by evacuating the negative kilogram calories into the passing air E4. The refrigerating fluid leaves E4 at the point 9 in low-pressure gaseous form.

For example, the temperature of the fluid at the point 9 will be −10° C.

The fluid passes through V3 No. 2 for the point 10.

The fluid returns to the exterior tube of the exchanger E3; because the flow rate of coolant in the inside cylinder of the exchanger E3 is zero, no superheating of the intake gases is implemented.

The fluid leaves the exchanger E3 at the point 11 and is drawn in by the compressor CP1. In this case, the temperature of the refrigerating fluid at the point No. 11 is the same as at the point No. 10.

The presence of the exchanger E3 in this case depicted is innovative because it is placed on a low-pressure liquid cross-section of the refrigeration circuit that is not always supplied with low-pressure liquid in its interior tube. The innovative design and location of the exchanger E3 allow this element to have functions that are different from those of requirements of calories and negative kilogram calories of the different exchangers that are installed.

In FIG. 3, the exchanger E3 has its interior tube cooled by the intake gases that pass through its exterior tube; this allows it to store—at 100% of its capacity—a large quantity of fluid in the liquid state in its interior tube.

This function is important because the exchanger E1, not being supplied with fluid, empties all of its fluid in the liquid state; it is therefore useful to be able to store this fluid in the volume of the inside cylinder of the exchanger E3, which itself remains cold.

If this function were not ensured, the exchanger E2 would have a reduced yield because of too large a quantity of fluid in the liquid state in the refrigeration circuit and in this same exchanger E2.

FIG. 4 shows the operation of the system with every other compressor in operation and a heat production that is ensured on the exchanger E2 and a refrigeration production that is ensured on the exchanger E1.

This operating mode is called energy transfer.

The compressor CP1 compresses and delivers the refrigerating fluid to the point No. 1. For example, we can have a reference temperature at the point No. 1 of 90° C.

The fluid passes through the exchanger E2, which is a plate exchanger that is irrigated with water by the circulator P2 for the distribution of calories.

The fluid that passes through the exchanger E2 is at high pressure and high temperature. The water that passes through the exchanger E2 is colder than the fluid; the calories leave the fluid for the water circuit E2.

In this case depicted, the fluid is condensed at 100% in the exchanger E2. For example, we can have a temperature of the water circuit at the inlet of 60° C. and at the outlet of 65° C. with a condensation temperature of 65° C.

The refrigerating fluid that leaves the exchanger E2 at the point 2 is therefore condensed and is colder than at the point No. 1.

For example, we can have a reference temperature at the point No. 2 of 64° C.

With the valve V3 No. 1 being closed, the refrigerating fluid passes through the point 15, the filter F, the point 16, the open valve VEM1, the point 17, the point 8, and the expansion valve D1. The fluid that passes through the expansion valve D1 is expanded and is therefore in low-pressure liquid form with a minority ratio in the gaseous phase at the point 7.

For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid in the gaseous state.

The ratio of low-pressure fluid to the gaseous state is found by gravity in the upper portion of the interior tube of the exchanger E3.

A portion of this volume of low-pressure refrigerating fluid is then evacuated via the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of the low-pressure fluid to the gaseous state that is less than the point 7.

The fluid passes through the capillary 1 that has a loss of pressure that is equivalent to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form.

The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The presence of the exchanger E3 in this case depicted is innovative because it is placed on a low-pressure liquid cross-section of the refrigeration circuit that is not always supplied with low-pressure liquid in its interior tube.

The innovative design and location of the exchanger E3 allow this element to have functions that are different from those of requirements of calories and negative kilogram calories of the different exchangers that are installed.

In FIG. 4, the exchanger E3 has its interior tube cooled by the intake gases that pass through its exterior tube; with the interior tube being supplied with a low-pressure liquid with a percentage of fluid in the gaseous state, it is advisable to reduce to the maximum the quantity of fluid in the gaseous state; the exchanger E3 allows this function by evacuating a portion of this gas via the tube 19 and by condensing another portion of this gas because of the cooling caused by the cold gases that pass through the exterior tube of the exchanger E3.

If this function were not ensured, the exchanger E1 would have a reduced yield because of a smaller quantity of fluid in the liquid state in the refrigeration circuit at the point 5 and in the exchanger E1 in evaporator mode; this would reduce the mean conductivity coefficient in the exchanger E1 and therefore the energy yield of the unit.

FIG. 5 shows the operation of the system with every other compressor in operation and a heat production that is ensured on the exchangers E2 and E4, and a refrigeration production that is ensured on the exchanger E1.

This operating mode is called partial energy transfer.

The compressor CP1 compresses and delivers the refrigerating fluid to the point No. 1. For example, we can have a reference temperature at the point No. 1 of 80° C.

The fluid passes through the exchanger E2, which is a plate exchanger that is irrigated with water by the circulator P2 for the distribution of calories.

The fluid that passes through the exchanger E2 is at high pressure and high temperature. The water that passes through the exchanger E2 is colder than the fluid; the calories leave the fluid for the water circuit E2.

In this case depicted, the fluid is partially desuperheated or condensed in the exchanger E2.

For example, in the case of a use of E2 as a desuperheater, without any condensation, we can have a temperature of the water circuit E2 at the inlet of 75° C. and at the outlet of 77° C. with a condensation temperature of 50° C.

The refrigerating fluid that leaves the exchanger E2 at the point 2 is therefore desuperheated and in the high-pressure gaseous state.

For example, we can have a reference temperature at the point No. 2 of 75° C.

The refrigerating fluid passes through the valve V3 No. 1, the point 14, the point 9, enters into the exchanger E4, or it is condensed at 100%.

To do this, the ventilator VENT is in operation for the cooling of the exchanger E4.

In this case depicted, the evacuation of calories is done on the exchanger E2 on behalf of the water circuit E2 and on the exchanger E4 for evacuating excess heat energy toward the outside.

This function is useful for the storage of hot water for domestic use with a temperature that is greater than 65° C. for the elimination of bacteria in summer. The fluid exits from the exchanger E4 at the point 8 and passes through the expansion valve D1.

The fluid that passes through the expansion valve D1 is expanded and is therefore found in low-pressure liquid form with a minority ratio in the gaseous phase at the point 7. For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid in the gaseous state.

The ratio of low-pressure fluid to the gaseous state is found by gravity in the upper portion of the interior tube of the exchanger E3.

A portion of this volume of low-pressure refrigerating fluid is then evacuated by the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of the low-pressure fluid to the gaseous state that is less than the point 7.

The fluid passes through the capillary that has a loss of pressure that is equivalent to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form. The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The operation of the exchanger E3 in this case depicted is identical to the preceding case of FIG. 4.

FIG. 6 shows the operation of the system with two compressors of two in operation, a heat production that is ensured on the exchanger E4 for defrosting, and a refrigeration production that is ensured on the exchanger E1.

This operating mode is called a defrosting mode.

The defrosting of the outside battery is used to eliminate the ice that blocks and insulates the outside finned battery that recovers the heat energy in the outside air.

The compressor CP1 compresses and delivers the refrigerating fluid to the point No. 1. For example, we can have a reference temperature at the point No. 1 of 80° C.

The fluid passes through the exchanger E2.

The circulator P2 is stopped so as not to transmit the calories to the water circuit E2. The refrigerating fluid that leaves the exchanger E2 at the point 2 is therefore in the high-pressure gaseous state and at the same temperature as at the point 1.

The refrigerating fluid passes through the valve V3 No. 1, the point 14, the point 9, enters into the exchanger E4, or it is condensed at 100%.

The ventilator VENT is stopped so as to preserve all of the heat energy of the refrigerating fluid for the defrosting of the battery.

The fluid exits from the exchanger E4 at the point 8, and passes through the expansion valve D1.

The fluid that passes through the expansion valve D1 is expanded and is therefore in low-pressure liquid form with a minority ratio in the gaseous phase at the point 7.

For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid in the gaseous state.

The ratio of low-pressure fluid to the gaseous state is found by gravity in the upper portion of the interior tube of the exchanger E3.

A portion of this volume of low-pressure refrigerating fluid is then evacuated by the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of low-pressure fluid to the gaseous state that is less than the point 7.

The fluid passes through the capillary that has a loss of pressure that is equal to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories into the water circuit E1.

The refrigerating fluid leaves E1 in low-pressure gaseous form.

The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The compressor CP2 is put into operation so as to reduce the duration of the defrosting by increasing the defrosting power by one level that is equal to the absorbed power of the compressor CP2.

The compressor CP2 delivers the refrigerating fluid at the point 13.

The refrigerating fluid passes the point 4, the three-way valve No. 2, the point 10, and the exchanger E3, and it is drawn in by the compressor CP2 after the point 13.

During this process, no expansion valve is installed; the delivery gases of the compressor CP2 are low-pressure and in the gaseous state.

The thus conveyed gas is charged with heat energy that is consumed by the compressor No. 2 and makes it possible to superheat the mixed intake gases of the two compressors in the exterior tube of the fluid/fluid exchanger E3.

Thus, we increase the temperature of the gas stream at the point 11 and therefore also the delivery temperature of the CP1 at the point 1.

This has the consequence of increasing the defrosting power by proposing a mixed defrosting system by cycle reversal and also by hot gas.

The operation of the exchanger E3 in this case depicted is identical to the preceding case of FIGS. 4 and 5.

FIG. 7 shows the operation of the system with every other compressor in operation and a heat production that is ensured on the exchanger E4 for evacuating the calories outside of the building and a refrigeration production that is ensured on the exchanger E1.

This operating mode is called a simple chilled water production mode.

The compressor CP1 compresses and delivers the refrigerating fluid to the point No. 1. For example, we can have a reference temperature at the point No. 1 of 80° C.

The fluid passes through the exchanger E2.

In this case depicted, we are considering that the water circuit 2 has no calorie requirement and therefore the circulator P2 is stopped so as not to transmit the calories to the water circuit E2.

The refrigerating fluid that leaves the exchanger E2 at the point 2 is therefore in the high-pressure gaseous state and at the same temperature as at the point 1.

The refrigerating fluid passes through the valve V3 No. 1, the point 14, and the point 9, and it enters into the exchanger E4 where it is condensed at 100%.

The ventilator VENT is put into operation to cool the outside finned exchanger E4.

The fluid exits from the exchanger E4 at the point 8 and passes through the expansion valve D1.

The fluid that passes through the expansion valve D1 is expanded and is therefore under low-pressure liquid form with a minority ratio in the gaseous phase at the point 7. For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid to the gaseous state.

The ratio of low-pressure fluid to the gaseous state is found by gravity in the upper portion of the interior tube of the exchanger E3.

A portion of this volume of low-pressure refrigerating fluid is then evacuated by the degassing tube at the point 19, which is a tap of the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of low-pressure fluid to the gaseous state that is less at the point 7.

The fluid passes through the capillary that has a loss of pressure that is equivalent to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form.

The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The operation of the exchanger E3 in this case depicted is identical to the preceding case of the FIGS. 4, 5, and 6.

FIG. 8 shows the operation of the system with two compressors of two in operation, and a heat production that is ensured on the exchangers E1 and E2.

The special feature of FIG. 8 is to show the addition of an additional exchanger E5 that is supplied with water by an additional water circuit that would have as its function, for example, to recover calories in the extraction of air from a building.

The compressor CP1 compresses and delivers the refrigerating fluid to the point No. 1. For example, we can have a reference temperature at the point No. 1 of 90° C.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2.

For example, we can have a temperature of the water circuit at the inlet of 45° C. and at the outlet of 48° C.

The refrigerating fluid that leaves the exchanger E2 at the point 2 is therefore colder than at the point No. 1.

For example, we can have a reference temperature at the point No. 2 of 45° C.

The refrigerating fluid passes through the valve V3 No. 1, the point No. 3, and the point No. 4 and No. 20 to then return to the exchanger E1.

With the water that passes through the exchanger E1 being colder than the fluid, the calories leave the fluid for the water circuit E1.

The refrigerating fluid condenses in the exchanger E1 and exits from the latter in high-pressure liquid form at the point No. 5.

For example, we can have a condensation temperature of 36° C., a temperature of the water circuit E1 at the inlet of 33° C. and at the outlet of 35° C.

The fluid passes through the nonreturn valve C1, the point 6, and returns to the inside cylinder of the fluid/fluid exchanger E3.

For example, at the point 6, the temperature of the fluid is 35° C.

The high-pressure condensed fluid is subcooled in the exchanger E3 and exits at the point 7.

For example, the temperature at the point 7 will be 30° C. or a subcooling of 5° C. by the exchanger E3.

The fluid passes through the expansion valve D1 where it is expanded and therefore in low-pressure liquid form with a minority ratio in the gaseous phase at the point 8. For example, the temperature of the fluid at the point 8 is −15° C.

The fluid passes through the exchanger E4 that is ventilated by the ventilator VENT.

The fluid enters into boiling by evacuating the negative kilogram calories into the passing air E4.

The refrigerating fluid leaves E4 at the point 9 in low-pressure gaseous form.

Upstream from the expansion valve D1 at the level of the point 7, a branch diverts a portion of the fluid in the high-pressure liquid state to the expansion valve D3. The fluid passes through the expansion valve D3 where it is expanded and therefore in low-pressure liquid form with a minority ratio in the gaseous phase.

For example, the temperature of the fluid at the point 8 is +1° C.

The fluid passes through the exchanger that is supplied with water by the circulator P3.

For example, the water for supplying the exchanger E5 has an inlet temperature of +12° C. and an outlet temperature of +7° C.

The low-pressure refrigerating fluid enters into boiling and exits in the gaseous state of the exchanger 6 to then pass through the control valve P.

The control valve P is a valve with automatic constant pressure that keeps the prevailing pressure of the refrigerating fluid in the exchanger E5 at a minimum equivalent value of 0° C. so that the evaporation temperature is higher than the freezing temperature of the water circuit E3.

For example, we will consider that the evaporation temperature in the exchanger E5 is +1° C. and that the temperature of the refrigerating gas that passes through the valve at constant pressure has a temperature of +10° C. and a 100% gaseous state.

The gaseous streams that come from the exchanger E5 and the exchanger E4 mix at the level of the point 9.

For example, the temperature of the fluid at the point 9 will be −5° C.

The fluid passes through V3 No. 2 for the point 10.

The fluid returns to the exterior tube of the exchanger E3 and is superheated upon contact with the interior tube of the exchanger E3.

The fluid leaves the exchanger E3 at the points 11 and 12; it is drawn in by the compressors CP1 and CP2.

For example, the temperature of the fluid at the points 11 and 12 is +1° C.

The compressor CP2 draws in the low-pressure gas at the point 12 and delivers the high-pressure fluid in the gaseous state at the point 13.

FIG. 9 explains the operation of the fluid/fluid exchanger E3 that corresponds to FIGS. 1, 2, and 8.

At the point 10, a stream of low-pressure refrigerating fluid in the gaseous and cold state enters into the outside cylinder of the exchanger E3.

The temperature of this fluid can be, for example, at a temperature of −10° C.

This stream of cold fluid in the gaseous state is in contact with the outside wall of the interior tube of the fluid/fluid exchanger E3.

The interior tube—being supplied with high-pressure fluid in the liquid state and at a temperature of, for example, 60° C., the stream of low-pressure refrigerating gas that comes from the point 10 and that exits at the point 11 to be drawn in by the compressor No. 1 and the point 12 to be drawn in by the compressor No. 2—is heated by the outside wall of the interior tube of the exchanger E3.

For example, the temperature at the points 11 and 12 can have a higher value of 10° C. relative to the point 10.

We will thus generate a superheating of the intake gases between the points 10 and 11 as well as between the points 10 and 12 when the compressor 2 is in operation.

Conversely, the high-pressure liquid in the liquid state that enters into the interior tube of the exchanger E3 is cooled by the wall of the interior tube upon contact with the cold gases of the exterior tube.

The diameter of the interior tube is to be at least 5 times greater than the diameter of the taps 6 and 7 so that the stream from the tube 6 does not move directly toward the tube 7. By the heat exchange of E3, the temperature of the fluid at the point 6 is higher than the temperature of the high-pressure refrigerating fluid in the liquid state that exits at the point 7.

We thus will generate a subcooling of the liquid between the points 6 and 7.

The tap at the point 19 has a zero flow rate because it ends at the point 20 and because the pressure at the point 20 is equivalent to that which prevails at the point 19. FIG. 10 explains the operation of the fluid/fluid exchanger E3 corresponding to FIGS. 4, 5, 6, and 7.

At the point 10, a stream of low-pressure refrigerating fluid in the gaseous and cold state enters into the outside cylinder of the exchanger E3.

The temperature of this fluid can be, for example, at a temperature of +6° C.

This stream of cold fluid in the gaseous state is in contact with the outside wall of the interior tube of the fluid/fluid exchanger E3.

With the interior tube being supplied at the point 7 with low-pressure fluid in the liquid state and at a temperature of, for example, +10° C., the stream of low-pressure refrigerating gas that comes from the point 10 and that exits at the point 11 to be drawn in by the compressor No. 1 and the point 12 to be drawn in by the compressor No. 2 is heated by the outside wall of the interior tube of the exchanger E3.

For example, the temperature at the points 11 and 12 can have a value that is higher by 2° C. relative to the point 10.

We thus will generate a superheating of the intake gases between the points 10 and 11 as well as between the points 10 and 12 when the compressor 2 is in operation.

Conversely, the low-pressure liquid in the liquid state that enters into the interior tube of the exchanger E3 is cooled by the wall of the interior tube upon contact with the cold gases of the exterior tube.

The diameter of the interior tube is to be at least 5 times larger than the diameter of the taps 7 and 6 so that the stream from the tube 7 does not move directly toward the tube 6. The low-pressure liquid that enters into the interior tube of the exchanger E3 is in the liquid state with a small ratio in the gaseous state because of the expansion at D1.

The heat exchange of E3 will have the result of cooling the interior tube and thus condensing a small portion of the low-pressure fluid in the gaseous state that is present at the top of the interior tube.

Another portion of the fluid in the gaseous state at the top of the interior tube will be evacuated by the tap 19.

Due to the presence of the capillary 1, the exchanger E1 in evaporator mode as well as the point 20 are supplied with fluid that has a pressure that is lower than that at the point 19.

There will therefore be a gas stream between the point 19 to the point 20 because the pressure at the point 19 is higher than the point 20.

The gas flow rate will be limited by the capillary 2, which will be calibrated to not be able to evacuate the entire gas pocket at the top of the interior tube of the exchanger E3.

It would be detrimental to the system that the low-pressure refrigerating fluid in the liquid state passes through the capillary 2 following the evacuation of all of the fluid in the gaseous state.

For the high-power installations, the capillary can be replaced by a thermostatic expansion valve with a superheating that is regulated to 5° C.

By this innovative operation, the ratio of fluid to the liquid state at the point 6 is higher than the ratio of liquid that is present at the point 7.

The symbol named R is a reservoir of refrigerating fluid.

It compensates for the quantity of fluid that is necessary for the proper operation of the installation based on different functions of the exchangers, outside conditions, and different starting temperatures on the water circuits.

There is a simplified version of this technology; this version is adapted more particularly to mono-compressor machines or to machines that have at least two compressors but with a delivery pipe of the compressor No. 2 that joins the delivery pipe of the compressor No. 1 at the point 1 instead of joining point 4 as indicated in FIGS. 1 to 8.

In addition to this modification at the delivery level, the expansion valve D2 is eliminated, and the pipe that passes to the point 17 ends at the point 6 instead of ending at the point 8 as indicated in FIGS. 1 to 8.

The representation of the latter is done in FIGS. 11 to 17.

In FIG. 11, the conveying of the fluid is identical to that of FIG. 1:

FIG. 11 shows the operation of the system with every other compressor in operation and a heat production that is ensured on the exchangers E1 and E2. The compressor CP1 compresses and delivers the refrigerating fluid to the point No. 1.

For example, we can have a reference temperature at the point No. 1 of 90° C.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2.

For example, we can have a temperature of the water circuit at the inlet of 45° C. and at the outlet of 48° C.

The refrigerating fluid that leaves the exchanger E2 at the point 2 is therefore colder than at the point No. 1.

For example, we can have a reference temperature at the point No. 2 of 44° C.

The refrigerating fluid passes through the valve V3 No. 1, the point No. 3, the point No. 4, and the point No. 20 to then return to the exchanger E1.

With the water that passes through the exchanger E1 being colder than the fluid, the calories leave the fluid for the water circuit E1.

The refrigerating fluid condenses in the exchanger E1 and exits from the latter in high-pressure liquid form at the point No. 5.

For example, we can have a condensation temperature of 36° C., a temperature of the water circuit E1 at the inlet of 33° C. and at the outlet of 35° C.

The fluid passes through the nonreturn valve C1, the point 6, and it returns to the inside cylinder of the fluid/fluid exchanger E3.

For example, at the point 6, the temperature of the fluid is 35° C.

The high-pressure condensed fluid is subcooled in the exchanger E3 and exits at the point 7.

For example, the temperature at the point 7 will be 30° C. or a subcooling of 5° C. due to the exchanger E3.

The fluid passes through the expansion valve D1 where it is expanded and therefore in low-pressure liquid form with a minority ratio in the gaseous phase at the point 8.

For example, the temperature of the fluid at the point 8 is −15° C.

The fluid passes through the exchanger E4 that is ventilated by the ventilator VENT.

The fluid enters into boiling by evacuating the negative kilogram calories into the passing air E4.

The refrigerating fluid leaves E4 at the point 9 in low-pressure gaseous form. For example, the temperature of the fluid at the point 9 will be −10° C.

The fluid passes through V3 No. 2 for the point 10.

The fluid returns to the exterior tube of the exchanger E3 and is superheated upon contact with the interior tube of the exchanger E3.

The fluid leaves the exchanger E3 at the point 11 and is drawn in by the compressor CP1. For example, the temperature of the fluid at the point 11 is −5° C.

The presence of the exchanger E3 in this case depicted is innovative because it is placed on a high-pressure liquid cross-section of the refrigeration circuit that is not always supplied with high-pressure liquid in its interior tube.

The innovative design and location of the exchanger E3 allow this element to have functions that are different from those of requirements of calories and negative kilogram calories of the different exchangers that are installed.

In FIG. 11, the exchanger E3 is used as a superheater of intake gases, a subcooler of high-pressure liquid upstream from the expansion valve D1, and it makes it possible to store a large quantity of fluid in the liquid state in its interior tube.

The superheating of the intake gases and the subcooling of the liquid upstream from the expansion valve D1 make it possible to increase the percentage of fluid in the liquid state in the exchanger E4 and therefore to increase the mean coefficient of conductivity of the exchanger E4, or a gain for the energy yield of the unit.

In FIG. 12, the function of the exchangers E1, E2 and E4 is identical to the function that is disclosed in FIG. 2, but the conveying of the fluid is different.

FIG. 12 shows the operation of the system with two compressors in operation and a heat production that is ensured on the exchangers E1 and E2.

The operation that is described in FIG. 12 is close to the operation that is described in FIG. 11; the differences are described below:

Increase of the mass flow rate of the fluid because of the activation of the compressor No. 2.

Compression and delivery of the fluid at the point 1 by the compressor CP1.

Compression and delivery of the fluid at the point 13 by the compressor CP2.

Mixture of these two streams at the point No. 1.

In this case, the calories of the compressors No. 1 and No. 2 will be evacuated by the exchangers E1 and E2 for the benefit of the water circuits E1 and E2.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2.

For example, we can have a temperature of the water circuit at the inlet of 45° C. and at the outlet of 48° C.

The refrigerating fluid that leaves the exchanger E2 at the point 2 is therefore colder than at the point No. 1.

For example, we can have a reference temperature at the point No. 2 of 45° C.

The refrigerating fluid passes through the valve V3 No. 1, the point No. 3, the point No. 4, and the point No. 20 to then return to the exchanger E1.

With the water that passes through the exchanger E1 being colder than the fluid, the calories leave the fluid for the water circuit E1.

The refrigerating fluid condenses in the exchanger E1 and exits from the latter in high-pressure liquid form at the point No. 5.

For example, we can have a condensation temperature of 36° C., a temperature of the water circuit E1 at the inlet of 33° C., and at the outlet of 35° C. The fluid passes through the nonreturn valve C1, the point 6, and returns to the inside cylinder of the fluid/fluid exchanger E3.

For example, in the point 6, the temperature of the fluid is 35° C.

The high-pressure condensed fluid is subcooled in the exchanger E3 and exits at the point 7.

For example, the temperature at the point 7 will be 30° C. or a subcooling of 5° C. due to the exchanger E3.

The fluid passes through the expansion valve D1 where it is expanded and therefore in low-pressure liquid form with a minority ratio in the gaseous phase at the point 8.

For example, the temperature of the fluid at the point 8 is −15° C.

The fluid passes through the exchanger E4, which is ventilated by the ventilator VENT.

The fluid enters into boiling by evacuating the negative kilogram calories into the passing air E4.

The refrigerating fluid leaves E4 at the point 9 in low-pressure gaseous form. For example, the temperature of the fluid at the point 9 will be −10° C.

The fluid passes through V3 No. 2 for the point 10.

The fluid returns to the exterior tube of the exchanger E3 and is superheated upon contact with the interior tube of the exchanger E3.

The fluid leaves the exchanger E3 at the point 11 and is drawn in by the compressor CP1. For example, the temperature of the fluid at the point 11 is −5° C.

The fluid leaves the exchanger E3 at the point 12 and is drawn in by the compressor CP2. The functions of the exchanger E3 are identical to FIGS. 11 and 12.

For example, the temperature of the fluid at the point 12 is −5° C.

In FIG. 13, the function of the exchangers E1, E2 and E4 is identical to the function that is disclosed in FIG. 3, but the conveying of the fluid is different.

FIG. 13 shows the operation of the system with every other compressor in operation and a heat production that is ensured on the exchanger E2. The compressor CP1 compresses and delivers the refrigerating fluid to the point No. 1.

For example, we can have a reference temperature at the point No. 1 of 110° C.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2.

In this case depicted, the fluid is condensed at 100% in the exchanger E2.

For example, we can have a temperature of the water circuit at the inlet of 60° C. and at the outlet of 65° C. with a condensation temperature of 65° C. The refrigerating fluid that leaves the exchanger E2 at the point 2 is therefore condensed and is colder than at the point No. 1.

For example, we can have a reference temperature at the point No. 2 of 64° C.

With the valve V3 No. 1 being closed, the refrigerating fluid passes through the point 15, the filter F, the point 16, the valve VEM2, the point 17, the point 6, the exchanger E3, the point 7, and the expansion valve D1.

The fluid that passes through the expansion valve D1 is expanded and is therefore in low-pressure liquid form with a minority ratio in the gaseous phase at the point 8. For example, the temperature of the fluid at the point 8 is −15° C.

The fluid passes through the exchanger E4, which is ventilated by the ventilator VENT.

The fluid enters into boiling by evacuating the negative kilogram calories into the passing air E4. The refrigerating fluid leaves E4 at the point 9 in low-pressure gaseous form.

For example, the temperature of the fluid at the point 9 will be −10° C.

The fluid passes through V3 No. 2 for the point 10.

The fluid returns to the exterior tube of the exchanger E3 and is superheated upon contact with the interior tube of the exchanger E3.

The fluid leaves the exchanger E3 at the point 11 and is drawn in by the compressor CP1. For example, the temperature of the fluid at the point 11 is −5° C.

The fluid leaves the exchanger E3 at the point 12 and is drawn in by the compressor CP2. For example, the temperature of the fluid at the point 12 is −5° C.

This function is important because the exchanger E1, not being supplied with fluid, empties all of its fluid in the liquid state; it is therefore useful to be able to store this fluid in the volume of the inside cylinder of the exchanger E3, which itself remains cold.

If this function were not ensured, the exchanger E2 would have a reduced yield because of too large a quantity of fluid in the liquid state in the refrigeration circuit and in this same exchanger E2.

In FIG. 14, the function of the exchangers E1, E2 and E4 is identical to the function that is disclosed in FIG. 4, but the conveying of the fluid is different.

FIG. 14 shows the operation of the system with two compressors of two in operation and a heat production that is ensured on the exchanger E2 and a refrigeration production that is ensured on the exchanger E1.

This operating mode is called energy transfer.

The compressor CP1 and the compressor CP2 compress and deliver the refrigerating fluid to the points No. 1 and No. 13.

The junction of the delivery tube of the compressor No. 2 is made at the point 1. For example, we can have a reference temperature at the point No. 1 of 90° C.

The fluid passes through the exchanger E2, which is a plate exchanger that is irrigated with water by the circulator P2 for the distribution of calories.

The fluid that passes through the exchanger E2 is at high pressure and high temperature. The water that passes through the exchanger E2 is colder than the fluid; the calories leave the fluid for the water circuit E2.

In this case depicted, the fluid is condensed at 100% in the exchanger E2. For example, we can have a temperature of the water circuit at the inlet of 60° C. and at the outlet of 65° C., with a condensation temperature of 65° C.

The refrigerating fluid that leaves the exchanger E2 at the point 2 is therefore condensed and is colder than at the point No. 1.

For example, we can have a reference temperature at the point No. 2 of 64° C.

With the valve V3 No. 1 being closed, the refrigerating fluid passes through the point 15, the filter F, the point 16, the open valve VEM1, the point 18, the point 8, and the expansion valve D1.

The fluid that passes through the expansion valve D1 is expanded and is therefore in low-pressure liquid form with a minority ratio in the gaseous phase at the point 7.

For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid to the gaseous state.

The ratio of low-pressure fluid to the gaseous state is found by gravity in the upper portion of the interior tube of the exchanger E3.

A portion of this volume of low-pressure refrigerating fluid is then evacuated via the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of low-pressure fluid to the gaseous state that is less than the point 7.

The fluid passes through the capillary 1 that has a loss of pressure that is equivalent to a drop in temperature of 9° C.

The fluid that is expanded by the capillary 1 passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form. The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1. For example, the temperature of the fluid at the point 11 is +7° C.

The fluid leaves the exchanger E3 at the point 12 and is drawn in by the compressor CP2. For example, the temperature of the fluid at the point 12 is +7° C.

In FIG. 15, the function of the exchangers E1, E2, and E4 is identical to the function that is disclosed in FIG. 5, but the conveying of the fluid is different.

The presence of the exchanger E3 in this case depicted is innovative because it is placed on a low-pressure liquid cross-section of the refrigeration circuit that is not always supplied with low-pressure liquid in its interior tube.

The innovative design and location of the exchanger E3 allow this element to have functions that are different from those of requirements of calories and negative kilogram calories of the different exchangers that are installed.

In FIG. 14, the exchanger E3 has its interior tube cooled by the intake gases that pass through its exterior tube; with the interior tube being supplied with a low-pressure liquid with a percentage of fluid in the gaseous state, it is advisable to reduce to the maximum the quantity of fluid in the gaseous state; the exchanger E3 allows this function by evacuating a portion of this gas via the tube 19 and by condensing another portion of this gas because of the cooling caused by the cold gases that pass through the exterior tube of the exchanger E3.

If this function were not ensured, the exchanger E1 would have a reduced yield because of a smaller quantity of fluid in the liquid state in the refrigeration circuit at the point 5 and in the exchanger E1 in evaporator mode; this would reduce the mean conductivity coefficient in the exchanger E1 and therefore the energy yield of the unit.

FIG. 15 shows the operation of the system with two compressors of two in operation, a heat production that is ensured on the exchangers E2 and E4, and a refrigeration production that is ensured on the exchanger E1.

This operating mode is called partial energy transfer.

The compressor CP1 and the compressor CP2 compress and deliver the refrigerating fluid to the points No. 1 and No. 13.

The junction of the delivery tube of the compressor No. 2 is made at the point 1. For example, we can have a reference temperature at the point No. 1 of 80° C.

The fluid passes through the exchanger E2, which is a plate exchanger that is irrigated with water by the circulator P2 for the distribution of calories.

The fluid that passes through the exchanger E2 is at high pressure and high temperature. The water that passes through the exchanger E2 is colder than the fluid; the calories leave the fluid for the water circuit E2.

In this case depicted, the fluid is partially desuperheated or condensed in the exchanger E2.

For example, in the case of E2 being used as a desuperheater without any condensation, we can have a temperature of the water circuit E2 at the inlet of 75° C. and at the outlet of 77° C. with a condensation temperature of 50° C.

The refrigerating fluid that leaves the exchanger E2 at the point 2 is therefore desuperheated and in the high-pressure gaseous state.

For example, we can have a reference temperature at the point No. 2 of 75° C. The refrigerating fluid passes through the valve V3 No. 1, the point 14, and the point 9, and it enters into the exchanger E4, where it is condensed at 100%.

To do this, the ventilator VENT is in operation for the cooling of the exchanger E4.

In this case depicted, the evacuation of calories is done on the exchanger E2 on behalf of the water circuit E2 and on the exchanger E4 for evacuating excess heat energy toward the outside.

This function is useful for the storage of hot water for domestic use with a temperature that is higher than 65° C. for the elimination of bacteria in summer.

The fluid exits from the exchanger E4 at the point 8 and passes through the expansion valve D1.

The fluid that passes through the expansion valve D1 is expanded and is therefore found in low-pressure liquid form with a minority ratio in the gaseous phase at the point 7. For example, the temperature of the fluid at the point 7 is +10° C. The fluid enters into the inside cylinder of the fluid/fluid exchanger E3 in the low-pressure liquid state and at a temperature of 10° C. with a variable ratio of low-pressure fluid to the gaseous state.

The ratio of low-pressure fluid to the gaseous state is found by gravity in the upper portion of the interior tube of the exchanger E3.

A portion of this volume of low-pressure refrigerating fluid is then evacuated by the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the points 11 and 12, and it is drawn in by the compressors CP1 and CP2.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of the low-pressure fluid to the gaseous state that is less than the point 7.

The fluid passes through the capillary that has a loss of pressure that is equivalent to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form. The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The fluid leaves the exchanger E3 at the point 12 and is drawn in by the compressor CP2.

For example, the temperature of the fluid at the point 12 is +7° C.

The operation of the exchanger E3 in this case depicted is identical to the preceding case of FIG. 14.

In FIG. 16, the function of the exchangers E1, E2 and E4 is identical to the function that is disclosed in FIG. 6, but the conveying of the fluid is different.

FIG. 16 shows the operation of the system with every other compressor in operation, a heat production that is ensured on the exchanger E4 for defrosting, and a refrigeration production that is ensured on the exchanger E1.

This operating mode is called a defrosting mode.

The defrosting of the outside battery is used to eliminate the ice that blocks and insulates the outside finned battery that recovers the heat energy in the outside air. The compressor CP1 compresses and delivers the refrigerating fluid to the point No. 1.

For example, we can have a reference temperature at the point No. 1 of 80° C.

The fluid passes through the exchanger E2.

The circulator P2 is stopped so as not to transmit the calories to the water circuit E2. The refrigerating fluid that leaves the exchanger E2 at the point 2 is therefore in the high-pressure gaseous state and at the same temperature as at the point 1.

The refrigerating fluid passes through the valve V3 No. 1, the point 14, and the point 9, and it enters into the exchanger E4, where it is condensed at 100%.

The ventilator VENT is stopped so as to preserve all of the heat energy of the refrigerating fluid for the defrosting of the battery.

The fluid exits from the exchanger E4 at the point 8, and passes through the expansion valve D1. The fluid that passes through the expansion valve D1 is expanded and is therefore in low-pressure liquid form with a minority ratio in the gaseous phase at the point 7.

For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid to the gaseous state.

The ratio of low-pressure fluid to the gaseous state is found by gravity in the upper portion of the interior tube of the exchanger E3.

A portion of this volume of low-pressure refrigerating fluid is then evacuated by the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of the low-pressure fluid to the gaseous state that is less than the point 7.

The fluid passes through the capillary that has a loss of pressure that is equivalent to a drop in temperature of 9° C.

The fluid that is expanded by the capillary 1 passes through the point 5 with a temperature that is equal to +1° C.

The fluid enters into the exchanger E1 where it enters into boiling by evacuating the negative kilogram calories on the water circuit E1. The refrigerating fluid leaves E1 in low-pressure gaseous form. The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3.

The fluid leaves the exchanger E3 at the point 11 and is drawn in by the compressor CP1.

For example, the temperature of the fluid at the point 11 is +7° C.

The operation of the exchanger E3 in this case depicted is identical to the preceding case of FIGS. 14 and 15.

In FIG. 17, the function of the exchangers E1, E2 and E4 is identical to the function that is disclosed in FIG. 7, but the conveying of the fluid is different.

FIG. 17 shows the operation of the system with two compressors of two in operation, a heat production that is ensured on the exchanger E4 for evacuating the calories outside of the building, and a refrigeration production that is ensured on the exchanger E1.

This operating mode is called a simple chilled water production mode.

The compressor CP1 and the compressor CP2 compress and deliver the refrigerating fluid to the points No. 1 and No. 13.

The junction of the delivery tube of the compressor No. 2 is made at the point 1.

For example, we can have a reference temperature at the point No. 1 of 80° C.

The fluid passes through the exchanger E2.

In this case depicted, we are considering that the water circuit E2 has no calorie requirement and therefore the circulator P2 is stopped so as not to transmit the calories to the water circuit E2.

The refrigerating fluid that leaves the exchanger E2 at the point 2 is therefore in the high-pressure gaseous state and at the same temperature as at the point 1.

The refrigerating fluid passes through the valve V3 No. 1, the point 14, the point 9, and enters into the exchanger E4, where it is condensed at 100%.

The ventilator VENT is in operation to cool the outside finned exchanger E4. The fluid exits from the exchanger E4 at the point 8 and passes through the expansion valve D1. The fluid that passes through the expansion valve D1 is expanded and is therefore in low-pressure liquid form with a minority ratio in the gaseous phase at the point 7.

For example, the temperature of the fluid at the point 7 is +10° C.

The fluid enters into the inside cylinder of the fluid/fluid exchanger E3 in the low-pressure liquid state and at a temperature of 10° C. with a variable ratio of low-pressure fluid to the gaseous state.

The ratio of low-pressure fluid to the gaseous state is found by gravity in the upper portion of the interior tube of the exchanger E3.

A portion of this volume of low-pressure refrigerating fluid is then evacuated via the degassing tube at the point 19, which is a tap in the upper portion of the interior tube of the fluid/fluid exchanger E3.

The low-pressure refrigerating fluid in the gaseous state then passes through the capillary 2, the nonreturn valve C2, the point 20, the valve V3 No. 2, the point 10, and the point 11, and it is drawn in by the compressor No. 1.

All of the low-pressure refrigerating fluid in the liquid state and the remaining low-pressure refrigerating fluid in the gaseous state that is not evacuated by the degassing tube at the point 19 exit at the point 6 of the interior tube of the exchanger E3 with a temperature that is equal to 10° C. and with a ratio of the low-pressure fluid to the gaseous state that is less than the point 7.

The fluid passes through the capillary that has a loss of pressure that is equivalent to a drop in temperature of 9° C.

The fluid that is expanded by the capillary passes through the point 5 with a temperature that is equal to +1° C.

The fluid enters into the exchanger E1 where it enters into boiling by evacuating the negative kilogram calories on the water circuit E1.

The refrigerating fluid leaves E1 in low-pressure gaseous form.

The refrigerating fluid exits from the exchanger E1, passes through the point 20, V3 No. 2, and the point 10.

For example, the temperature of the fluid at the point 10 will be +5° C.

The fluid returns to the exterior tube of the exchanger E3 and is superheated upon contact with the interior tube of the exchanger E3. The fluid leaves the exchanger E3 at the point 11 and is drawn in by the compressor CP1.

For example, the temperature of the fluid at the point 11 is +7° C.

The fluid leaves the exchanger E3 at the point 12 and is drawn in by the compressor CP1.

For example, the temperature of the fluid at the point 12 is +7° C. The operation of the exchanger E3 in this case depicted is identical to the preceding case of FIGS. 14, 15, and 16.

FIG. 18 shows the operation of the system with two compressors of two in operation, and a heat production that is ensured on the exchanger E2 and on the exchanger E1.

FIG. 18 is not part of the simplified system and therefore integrates the expansion valve D2 into its fluid diagram.

The compressor CP1 compresses and delivers the refrigerating fluid to the point No. 1.

For example, we can have a reference temperature at the point No. 1 of 110° C.

The fluid passes through the exchanger E2, which is a plate exchanger that is irrigated with water by the circulator P2 for the distribution of calories.

The fluid that passes through the exchanger E2 is at high pressure and high temperature. With the water that passes through the exchanger E2 being colder than the fluid, the calories leave the fluid for the water circuit E2. In this case depicted, the fluid is condensed at 100% in the exchanger E2.

For example, we can have a temperature of the water circuit at the inlet of 60° C. and at the outlet of 65° C. with a condensation temperature of 65° C.

The refrigerating fluid that leaves the exchanger E2 at the point 2 is therefore condensed and colder than at the point No. 1.

For example, we can have a reference temperature at the point No. 2 of 64° C.

With the valve V3 No. 1 being closed, the refrigerating fluid passes through the point 15, the filter F, the point 16, the valve VEM2, and the expansion valve D2.

The fluid that passes through the expansion valve D2 is expanded and is therefore in low-pressure liquid form with a minority ratio in the gaseous phase at the point 18.

For example, the temperature of the fluid at the point 18 is −15° C.

The compressor CP2 compresses and delivers the refrigerating fluid to the point No. 13. For example, we can have a reference temperature at the point No. 13 of 60° C.

The fluid passes through the point 4, and the point 20, and it enters into the exchanger E1, which is a plate exchanger that is irrigated with water by the circulator P2 for the distribution of calories.

The fluid that passes through the exchanger E1 is at high pressure and high temperature. With the water that passes through the exchanger E1 being colder than the fluid, the calories leave the fluid for the water circuit E1.

In this case depicted, the fluid is condensed at 100% in the exchanger E1.

For example, we can have a temperature of the water circuit at the inlet of 30° C. and at the outlet of 35° C. with a condensation temperature of 38° C.

The refrigerating fluid that leaves the exchanger E1 at the point 5 is therefore condensed and is colder than at the point No. 20.

For example, we can have a reference temperature at the point No. 2 of 37° C.

The refrigerating fluid that comes from the point 5 passes through the nonreturn valve C1, the point 6, enters into the interior tube of the fluid/fluid exchanger E3, passes through the point 7, and passes through and is expanded by the expansion valve D1.

The fluid that passes through the expansion valve D1 is expanded and is therefore in low-pressure liquid form with a minority ratio in the gaseous phase at the point 8.

For example, the temperature of the fluid at the point 8 is −15° C.

The streams of refrigerating fluid that come from the point 8 and the point 18 are mixed at the inlet of the exchanger E4. The fluid passes through the exchanger E4, which is ventilated by the ventilator VENT. The fluid enters into boiling by evacuating the negative kilogram calories in the passing air E4. The refrigerating fluid leaves the exchanger E4 at the point 9 in the low-pressure gaseous form.

For example, the temperature of the fluid at the point 9 will be −10° C.

The fluid passes through V3 No. 2 for the point 10.

The fluid returns to the exterior tube of the exchanger E3 and is superheated upon contact with the interior tube of the exchanger E3. The fluid leaves the exchanger E3 at the points 11 and 12 and is drawn in by the compressors CP1 and CP2.

In the case of FIG. 18, we have a different condensation temperature between the exchangers E1 and E2 and therefore the compressors CP1 and CP2.

The lower the condensation temperature and the higher the energy yield of the compressor, this possibility is therefore beneficial to the overall yield of the installation.

This possibility of operation is particular to the principle in its fluid diagram with the integration of the expansion valve D2 (FIGS. 1 to 8, and FIG. 18).

The simplified version of the fluid diagram that eliminates the expansion valve D2 does not allow a different condensation temperature between E1 and E2, but it makes possible a reduction of the production cost (FIGS. 11 to 17).

The invention claimed is:

1. A reversible system for recovery by sampling and transfer of energy between at least two different media, or between an outside medium and a biotope or between a biotope and another biotope, by using as a vehicle a refrigerating fluid that passes successively from a gaseous state to a liquid state and vice versa by a succession of phases of compression and expansion, comprising:

at least one primary compressor (CP1) that is connected to a fluid/fluid exchanger E3 at a tapping 11 and to a non-reversible exchanger E2 at a tapping 1, a capillary CAPILLARY 2 for limiting the flow of fluid in the gaseous state that comes from the fluid/fluid exchanger E3, an exchanger E4 for the recovery or the evacuation of calories on the outside medium, whereby the exchanger E4 is a finned exchanger for AIR/WATER heat pumps, or a plate exchanger, or a multi-tubular or coaxial exchanger for WATER/WATER heat pumps, a bi-flow thermostatic expansion valve D1 with outside equalization for expanding the refrigerating fluid from a tapping 7 to a tapping 8 when the exchanger E4 is in evaporator mode and for expanding the refrigerating fluid from the tapping 8 to the tapping 7 when an exchanger E1 is in evaporator mode, a capillary CAPILLARY 1 for ensuring a final expansion of the fluid in the expanded liquid state by said bi-flow thermostatic expansion valve D1, the fluid/fluid exchanger E3 is connected by a tapping 6 to the final expansion capillary CAPILLARY 1, to a non-return valve C1, to a reservoir R, by the tapping 7 to said bi-flow thermostatic expansion valve with outside equalization D1, by a tapping 19 to said capillary CAPILLARY 2 for the limitation of the mass flow rate on this branch, by a tapping 10 to an intake of the cold gases that come from a valve V3 No. 2, by the tapping 11 to an intake of superheated gases by said compressor CP1, said fluid/fluid exchanger E3 having two modes of operation:

when said fluid/fluid exchanger E3 is supplied at the tapping 7 with low-pressure fluid in the liquid state with a small ratio of fluid to the gaseous state, said exchanger condenses a portion of this fluid in the gaseous state and evacuates, via a tapping 19, another portion of this fluid in the gaseous state so as to increase the ratio of liquid in a tapping 6 of the exchanger E3, when said fluid/fluid exchanger E3 is supplied at the tapping 6 with high-pressure fluid in the liquid state, said exchanger E3 operates as subcoolant of this high-pressure fluid in the liquid state and as superheater of the intake gases between the tapping 10 and at least the tapping 11, said refrigerating fluid reservoir R that contains a refrigerating fluid reserve, said nonreturn valve C1 making possible the diversion of the fluid from a tapping 5 to the tapping 6 when the exchanger E1 is used as a condenser, a nonreturn valve C2 to prevent a reflux of fluid from a tapping 20 to the tapping 19 when the exchanger E1 is used as a condenser, a motorized three-way valve V3 No. 1 for allowing operation of the exchanger E2 in a mode of desuperheater, total or partial condenser, and the diversion of the stream of refrigerating fluid to the exchanger E1 or the exchanger E4, a motorized three-way valve V3 No. 2 for allowing the operation of the exchanger E1 in evaporator mode or of the exchanger E4 in evaporator mode, a solenoid valve VEM1 through which the refrigerating fluid passes from a tapping 16 to a tapping 17 when the exchanger E1 is in evaporator mode and the exchanger E2 is in condenser mode, a solenoid valve VEM2 through which the refrigerating fluid passes from the tapping 16 to a tapping 18 when the exchanger E4 is in evaporator mode and the exchanger E2 is in condenser mode, a simple-flow expansion valve D2 for the expansion of the fluid between the tapping 16 and the tapping 18 when the exchanger E4 is in evaporator mode and the exchanger E2 is in condenser mode.

2. The reversible system according to claim 1, the system further comprising:

either one or more secondary compressors (CS) that are connected to said fluid/fluid exchanger E3 at the point 12 and to said non-reversible exchanger E2 at the point 1 via a pipe 13, or one or more secondary compressors (CS) that are connected to said fluid/fluid exchanger E3 at the point 12 and to said reversible exchanger E1 at the point 20 via pipes 13 and 4.

3. The reversible system according to claim 1, including connection of the intake of the compressor(s) to a fluid/fluid exchanger E3, which ensures, among other functions, the superheating of the intake gases before compression of the latter.

4. The reversible system according to claim 1, further comprising a bi-flow thermostatic expansion valve D1 that is coupled to the fluid/fluid exchanger E3 that ensures, among other functions, the subcooling of the high-pressure liquid at the tapping 7 when the fluid passes through the expansion valve D1 from the tapping 7 to the tapping 8.

5. The reversible system according to claim 1, wherein a bi-flow thermostatic expansion valve D1 is coupled to the fluid/fluid exchanger E3 that ensures, among other functions, the partial degassing of the low-pressure liquid, via the tube 1 and the capillary CAPILLARY 2, upstream from the capillary CAPILLARY 1 for the final expansion when the fluid passes through the expansion valve D1 by the fluid from the t tapping 8 to the tapping 7.

6. The reversible system according to claim 1, wherein a reservoir is supplied with high-pressure liquid when the exchanger E1 is in condenser mode and is supplied with low-pressure liquid with a minority percentage of fluid in the gaseous state when the exchanger E1 is in evaporator mode.

7. The reversible system to claim 1, wherein a three-way valve No. 1 for the supply of high-pressure refrigerating fluid in the gaseous state or in the liquid state or in a mixed state of mixed liquid and gas to the outside exchanger E4 or the exchanger E1.

8. The reversible system according to claim 1, wherein a three-way valve No. 2 supplies low-pressure refrigerating fluid in the gaseous state to the fluid/fluid exchanger E3 and the selection of the exchanger E4 or E1 in evaporator mode.

9. The reversible system according to claim 1, wherein a fluid/water exchanger E2 for the desuperheating or the total or partial condensation of delivery gases of the compressor(s) is connected at the tapping 1 for a production of hot water on the circuit E2.

10. The reversible system according to claim 1, wherein the exchanger E1 is for total condensation or total evaporation of the refrigerating fluid that passes through exchanger 1 for a production of hot water or chilled water on a water circuit.

11. The reversible system according to claim 1, wherein the exchanger E4 is for total condensation or total evaporation of the refrigerating fluid that passes through exchanger E4 for a recovery or an evacuation of calories to an outside medium.

12. The reversible system according to claim 1, wherein the capillary CAPILLARY 1 is for final expansion of partially degassed fluid that comes from the fluid/fluid exchanger E3 when E1 is in evaporator mode.

13. The reversible system according to claim 1, wherein the capillary CAPILLARY 2 limits the flow of fluid coming from the fluid/fluid exchanger E3 in gaseous form when exchanger E1 is in evaporator mode.

14. The reversible system according to claim 1, a wherein the nonreturn valve C1 diverts the fluid between the tappings 5 and 6 when the exchanger E1 is in condenser mode.

15. The reversible system according to claim 1, wherein the nonreturn valve C2 prevents circulation of the refrigerating fluid from the tapping 20 to the tapping 19 when the exchanger E1 is in condenser mode.

16. The reversible system according to claim 1, wherein an electromagnetic valve VEM1 allows passage of the fluid from the tapping 16 to the tapping 17 when the exchanger E2 is in condenser mode and the exchanger E1 is in evaporator mode.

17. The reversible system according to claim 1, wherein an electromagnetic valve VEM2 allows passage of the fluid from the tapping 16 to the tapping 18 when the exchanger E2 is in condenser mode and the exchanger E4 is in evaporator mode.

18. The reversible system according to claim 1, wherein a simple-flow thermostatic expansion valve D2 is for expansion, and a supply of expanded liquid from the exchanger E4 when the latter is in evaporator mode and when the exchanger E2 is in condenser mode.

19. The reversible system according to claim 2, wherein the intake of the compressor(s) is connected to the fluid/fluid exchanger E3, which ensures, among other functions, superheating of the intake gases before compression of the latter.

* * * * *